US012752338B2

(12) United States Patent
Rohatgi et al.

(10) Patent No.: US 12,752,338 B2
(45) Date of Patent: Oct. 6, 2026

(54) FORMATION OF METAL ARTICLES USING LOCALIZED SONICATION

(71) Applicant: Battelle Memorial Institute, Richland, WA (US)

(72) Inventors: Aashish Rohatgi, Richland, WA (US); Jon L. Helgeland, Richland, WA (US); Jens T. Darsell, Richland, WA (US); Mert Efe, West Richland, WA (US); Naveen K. Karri, Richland, WA (US); Katherine E. Rader, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 18/957,394

(22) Filed: Nov. 22, 2024

(65) Prior Publication Data

US 2026/0145228 A1 May 28, 2026

(51) Int. Cl.
*B22D 27/08* (2006.01)

(52) U.S. Cl.
CPC ..... *B22D 27/08* (2013.01)

(58) Field of Classification Search
CPC ..... B22D 27/00; B22D 11/114; B22D 23/00; B22D 13/101; B22D 11/003; B22D 27/08
See application file for complete search history.

(56) References Cited

U.S. PATENT DOCUMENTS

2024/0316623 A1* 9/2024 Ya ..... B22D 11/003

FOREIGN PATENT DOCUMENTS

JP 2013066920 A * 4/2013

OTHER PUBLICATIONS

Otsuka Shinji; JP-2013066920-A; machine translation (Year: 2013).*
Rader, Katherine E., "Microstructural refinement in ultrasonically modified A356 aluminum castings", [Online]. Retrieved from the Internet https doi.org 10.1007 s10853-023-08999-y, Nov. 23, 2023, 22 pages.

* cited by examiner

*Primary Examiner* — Lee A Holly
(74) *Attorney, Agent, or Firm* — Schwegman, Lundberg & Woessner, P.A.

(57) ABSTRACT

Implementations are described herein that include placing an amount of liquid metal into a container and applying sound energy at one or more locations of the container while the metal cools. Articles can be formed that include a bulk region and one or more modified regions proximate to boundaries of the articles that correspond to the one or more locations at which the sound energy was applied.

18 Claims, 20 Drawing Sheets

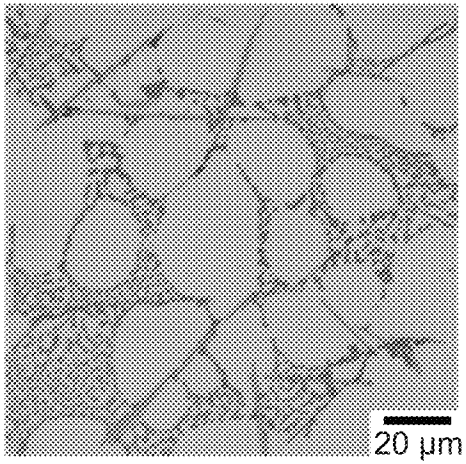
Figure 17C
Figure 17B
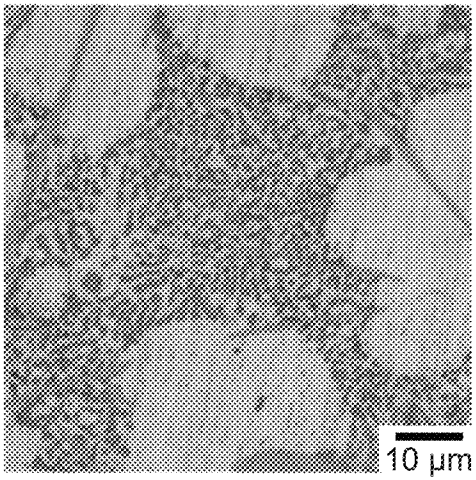
Figure 17A

FORMATION OF METAL ARTICLES USING LOCALIZED SONICATION

STATEMENT AS TO RIGHTS TO DISCLOSURES MADE UNDER FEDERALLY-SPONSORED RESEARCH AND DEVELOPMENT

This invention was made with Government support under Contract DE-AC05-76RL01830 awarded by the U.S. Department of Energy. The Government has certain rights in the invention.

FIELD OF THE INVENTION

One or more implementations relate to performing sonication with respect to an amount of metal at specified locations of a mold with the amount of metal being in a liquid state and subject to cooling while in the mold.

BACKGROUND

Objects can be formed having a given shape using a number of techniques. The shape of the object can be related to the uses for the object. In some cases, objects can be produced using dies and molds. For example, various objects can be produced using a casting process that includes pouring an amount of liquid material into a mold. The mold can have a cavity that is formed in the shape of a given object and the metal material can take the shape of the mold as the material cools within the mold. In other instances, objects can be produced by heating metal and subjecting the heated metal to processes, such as forging, rolling, hammering extruding, and the like, to form the heated metal into a given shape. Objects produced using a casting process can have mechanical properties that are different from the mechanical properties of objects formed using other processes.

BRIEF DESCRIPTION OF THE DRAWINGS

FIG. 17A includes a micrograph depicting the morphology of the Si phase particles in the as-cast condition for the dendritic microstructural morphology of the A356+Fe control casting, FIG. 17B includes a micrograph depicting the morphology of the Si phase particles in the as-cast condition for the globular microstructural morphology of the A356+Fe ultrasonicated casting, and FIG. 17C includes a micrograph depicting he morphology of the Si phase particles in the as-cast condition for the fine-grained microstructural morphology of the A356+Fe ultrasonicated casting.

DETAILED DESCRIPTION

Figure 1:
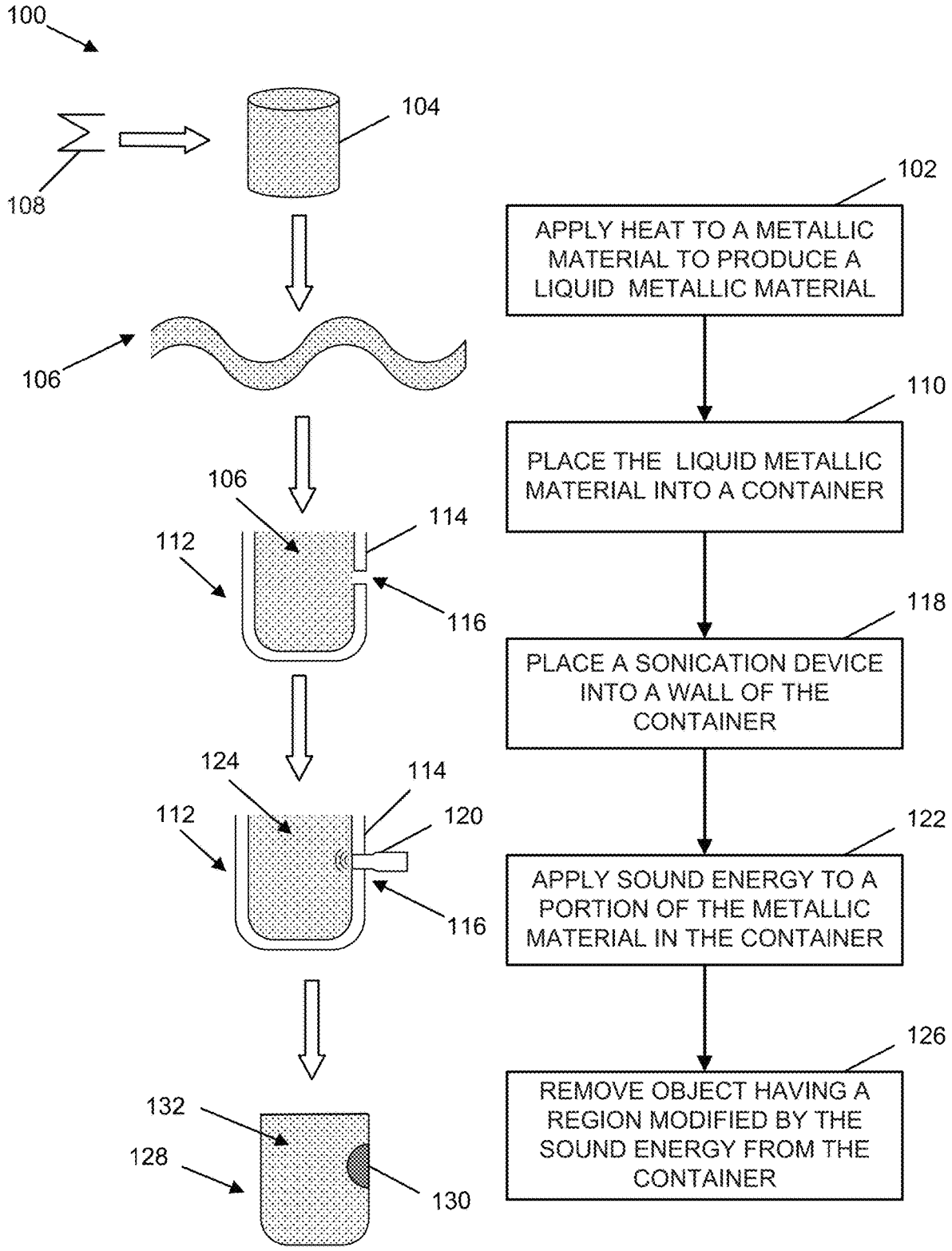
FIG. 1 illustrates a process to apply sonication to an amount of metal disposed within a mold while the metal cools from a liquid state to a solid state or a semi-solid state, in accordance with one or more examples.

The following description includes a preferred best mode of implementations of the present disclosure. It will be clear from this description of the disclosure that the disclosure is not limited to these illustrated implementations but that the disclosure also includes a variety of modifications and embodiments thereto. Therefore, the present description should be seen as illustrative and not limiting. While the disclosure is susceptible of various modifications and alternative constructions, it should be understood, that there is no intention to limit the disclosure to the specific form disclosed, but, on the contrary, the disclosure is to cover all modifications, alternative constructions, and equivalents falling within the spirit and scope of the disclosure.

Industrial processes can be used to manufacture metallic objects. In at least some examples, the metallic objects can be used in transportation and recreational vehicles, motors, transmissions, generators, and other machines. Typically, metallic materials can be relatively heavy and can reduce the performance of the vehicle or machine in which the objects formed from the metallic materials are located. In many situations, replacing objects in the vehicles and machines having the relatively heavy objects with objects having a lighter weight can improve the efficiency of the vehicles and machines. However, in various situations, objects formed from lighter weight materials may not possess mechanical properties that are suitable for the intended use of the objects.

Additionally, the processes used to manufacture metallic objects can impact the properties of the objects. In various situations, metallic objects can be efficiently produced using casting processes that dispose liquid metal into a mold. In at least some scenarios, the shape of the mold and/or the physical properties of the metal can result in areas of weakness in a given object. To minimize these areas of weakness, existing processes implement techniques that can change the microstructure of the objects. For example, process conditions for casting processes can be modified to impact the cooling process of the metal disposed in the mold. In addition, physical properties of the mold can impact the properties of objects formed using the mold. Further, chemical additives can be added to the liquid metal to modify the microstructure of objects produced using a casting process. In still other examples, additional operations can be performed after an object has been produced using a casting process that can change the as-cast microstructure of the object in an attempt to modify the physical properties of the object.

The implementations described herein are directed to applying sound energy to one or more locations of a mold to modify the microstructure of the metallic material within the mold. The modification of the microstructure of the metallic material within the mold can modify the physical properties of metallic objects formed in the mold at the locations where the sound energy was applied. In some existing processes, sonic energy can be applied prior to liquid metal entering the mold. In additional existing processes, sonic energy can be applied by placing a sonication probe into the liquid metal after the metal has been disposed in the mold, such as placing a sonication probe into the top of a mold that is holding an amount of liquified metal. Inserting the probe from the top of a mold is feasible in simple mold shapes which have an opening on the top, such as a hollow cylindrical container. However, if the shape of the mold is not simple then the probe cannot be bent around curves/corners to reach locations further away from the pouring location. For example, the mold can have a vertically oriented "L"-shape such that the vertical segment of the "L" letter is vertical and open at the top while the bottom horizontal segment of the "L" is horizontal and closed. Moreover, even if the probe could be inserted from the top, pouring location into such mold containing curves and corners, the metal could solidify at the far end, thus, trapping the transducer inside and removal of the probe after solidification would likely result in destroying the casting itself. Thus, the implementations described herein allow any location in the mold to be accessed by the ultrasound probe since the probe is not being inserted from the top or where the metal was poured. Further, for implementations described herein, the probe can be removed after solidification without cutting the casting and the probe can be reused in another casting. In one or more examples, the processes described herein include placing one or more sonication probes within one or more sidewalls of the mold and activating the one or more sonication probes as the liquid metal is added to the mold and during the cooling of the metal. Applying sound energy to the liquid metal during the cooling process modifies the microstructure of the metal at one or more locations where the sound energy is applied. In various examples, applying sound energy to the liquid metal disposed in the mold and during the cooling process can reduce the sizes of grains at the locations where the sound energy is applied. These modifications to the microstructure improve the physical properties of the objects formed using the processes and techniques described herein.

The processes and techniques described herein avoid the addition of chemical additives, such as grain refiners, that are limited in their effectiveness to reduce grain sizes of the metallic materials and that can change the composition of the metallic material being used to produce a given object. The addition of chemical additives can prevent or increase the difficulty of recycling the metallic materials that include the chemical additives. Further, the processes and techniques described herein can avoid post-processing operations and additional processing operations that may modify the microstructure of objects, but that decrease the efficiency in the production of metallic objects and that add costs to the production of metallic objects. The processes and techniques described herein also enable the re-use of sonication probes while maximizing the amount of time that the sound energy is applied to the object as it is being formed. For example, in situations where a sonication probe is inserted into the top of a container in which a liquid metal is disposed, e.g., inserting the probe at the location where the molten metal is being poured, the sonication probe can be rendered not reusable if it is not removed from the molten metal before the molten metal surrounding the ultrasound probe solidifies. In the techniques and processes described herein, the probe can be easily removed from its location in the wall after the molten metal has solidified and can be reused for the next casting. Removing the sonication probe prior to the metal being fully solidified can decrease any beneficial changes to the microstructure of the object. Additionally, the techniques and processes described herein can provide a more targeted approach that focuses on changing the microstructure of an object at specific points of potential weakness of the object rather than a more general approach employed by other existing techniques that aim to modify the microstructure of objects formed using casting processes.

FIG. 1 illustrates a process 100 to apply sonication to an amount of metal disposed within a mold while the metal cools from a liquid state to a solid state or a semi-solid state, in accordance with one or more examples. The process 100 can include, at 102, applying heat to a metallic material 104 to produce a liquid metallic material 106. In one or more examples, a heat source 108 can cause the temperature of the metallic material 104 to increase above the liquidus. The heat source 108 can increase the temperature of the metallic material 104 using at least one of radiation, convection, conduction, or induction. In one or more examples, the heat source 108 can use a contactless method to increase the temperature of the metallic material 104 or a contact method to increase the temperature of the metallic material 104. In one or more illustrative examples, the heat source 108 can be included in a furnace or an oven.

In one or more additional illustrative examples, the metallic material 104 can be superheated to produce the liquid metallic material 106. For example, the metallic material 104 can be heated at least about 10° C. above the melting temperature of the metallic material 104, at least about 20° C. above the melting temperature of the metallic material 104, at least about 30° C. above the melting temperature of the metallic material 104, at least about 40° C. above the melting temperature of the metallic material 104, at least about 50° C. above the melting temperature of the metallic material 104, at least about 60° C. above the melting temperature of the metallic material 104, at least about 70° C. above the melting temperature of the metallic material 104, at least about 80° C. above the melting temperature of the metallic material 104, at least about 90° C. above the melting temperature of the metallic material 104, at least about 100° C. above the melting temperature of the metallic material 104, at least about 110° C. above the melting temperature of the metallic material 104, or at least about 120° C. above the melting temperature of the metallic material 104.

In one or more examples, the metallic material 104 can be comprised of at least one of one or more metals or one or more alloys of metals. In various examples, the metallic material 104 can be comprised of at least one of aluminum, one or alloys of aluminum, copper, one or more alloys of copper, iron, one or more alloys of iron, or a steel. In various examples, the metallic material 104 can be comprised of an alloy of aluminum that includes at least one of silicon, magnesium, iron, titanium, copper, manganese, nickel, gallium, vanadium, chromium, zinc, or strontium.

In one or more illustrative examples, the metallic material 104 can be comprised of at least about 65% by weight aluminum, at least about 68% by weight aluminum, at least about 70% by weight aluminum, at least about 72% by weight aluminum, at least about 75% by weight aluminum, at least about 78% by weight aluminum, or at least about 80% by weight aluminum. In one or more additional illustrative examples, the metallic material 104 can be comprised of no greater than about 99% by weight aluminum, no greater than about 98% by weight aluminum, no greater than about 95% by weight aluminum, no greater than about 92% by weight aluminum, no greater than about 90% by weight aluminum, no greater than about 88% by weight aluminum, no greater than about 85% by weight aluminum, or no greater than about 82% by weight aluminum. In one or more further illustrative examples, the metallic material 104 can be comprised of from about 65% to about 99% by weight aluminum, from about 70% by weight to about 95% by weight aluminum, from about 75% by weight to about 92% by weight aluminum, from about 80% by weight to about 90% by weight aluminum, from about 82% by weight to about 92% by weight aluminum, from about 84% by weight to about 94% by weight aluminum, from about 86% by weight to about 96% by weight aluminum, from about 88% by weight to about 98% by weight aluminum, from about 90% by weight to about 95% by weight aluminum, from about 91% by weight to about 96% by weight aluminum, from about 92% by weight to about 97% by weight aluminum, from about 93% by weight to about 98% by weight aluminum, or from about 94% by weight to about 99% by weight aluminum.

In at least some examples, the metallic material 104 can be comprised of at least about 0.01% by weight, at least about 0.5% by weight silicon, at least about 1% by weight silicon, at least about 1.5% by weight silicon, at least about 2% by weight silicon, at least about 2.5% by weight silicon, at least about 3% by weight silicon, at least about 3.5% by weight silicon, at least about 4% by weight silicon, at least about 4.5% by weight silicon, at least about 5% by weight silicon, at least about 5.5% by weight silicon, at least about 6% by weight silicon, at least about 6.5% by weight silicon, at least about 7% by weight silicon, at least about 7.5% by weight silicon, at least about 8% by weight silicon, at least about 8.5% by weight silicon, at least about 9% by weight silicon, at least about 9.5% by weight silicon, or at least about 10% by weight silicon. Additionally, the metallic material 104 can be comprised of no greater than about 30% by weight silicon, no greater than about 28% by weight silicon, no greater than about 25% by weight silicon, no greater than about 22% by weight silicon, no greater than about 20% by weight silicon, no greater than about 18% by weight silicon, no greater than about 15% by weight silicon, or no greater than about 12% by weight silicon. In various illustrative examples, the metallic material 104 can be comprised of from about 0.01% by weight to about 30% by weight silicon, from about 1% by weight to about 10% by weight silicon, from about 10% by weight silicon to about 20% by weight silicon, from about 20% by weight silicon to about 30% by weight silicon, from about 2% by weight to about 8% by weight silicon, from about 3% by weight to about 7% by weight silicon, from about 1% by weight to about 4% by weight silicon, from about 2% by weight to about 5% by weight silicon, from about 3% by weight to about 6% by weight silicon, from about 4% by weight to about 7% by weight silicon, from about 5% by weight to about 8% by weight silicon, from about 6% by weight to about 9% by weight silicon, or from about 7% by weight to about 10% by weight silicon.

The metallic material 104 can also be comprised of at least about 0.01% by weight iron, at least about 0.05% by weight iron, at least about 0.1% by weight iron, at least about 0.15% by weight iron, at least about 0.2% by weight iron, at least about 0.25% by weight iron, at least about 0.3% by weight iron, at least about 0.35% by weight iron, at least about 0.4% by weight iron, at least about 0.45% by weight iron, at least about 0.5% by weight iron, at least about 0.55% by weight iron, at least about 0.6% by weight iron, at least about 0.65% by weight iron, at least about 0.7% by weight iron, at least about 0.75% by weight iron, at least about 0.80% by weight iron, at least about 0.85% by weight iron, at least about 0.90% by weight iron, at least about 0.95% by weight iron, at least about 1.00% by weight iron, at least about 1.10% by weight iron, at least about 1.20% by weight iron, at least about 1.30% by weight iron, or at least about 1.40% by weight iron. In addition, the metallic material 104 can be comprised of no greater than about 5% by weight iron, no greater than about 4.8% by weight iron, no greater than about 4.5% by weight iron, no greater than about 4.2% by weight iron, no greater than 4% by weight iron, no greater than about 3.8% by weight iron, no greater than about 3.5% by weight iron, no greater than about 3.2% by weight iron, no greater than about 3.0% by weight iron, no greater than about 2.8% by weight iron, no greater than about 2.5% by weight iron, no greater than about 2.2% by weight iron, or no greater than about 2.0% by weight iron. In one or more additional illustrative examples, the metallic material 104 can be comprised of from about 0.01% by weight to about 5% by weight iron, from about 0.5% by weight to about 4% by weight iron, from about 1% by weight to about 3% by weight iron, from about 3% by weight iron to about 5% by weight iron, from about 0.1% by weight to about 1.5% by weight iron, from about 0.5% by weight to about 1% by weight iron, from about 0.01% by weight to about 0.2% by weight iron, from about 0.1% by weight to about 0.3% by weight iron, from about 0.2% by weight to about 0.4% by weight iron, from about 0.3% by weight to about 0.5% by weight iron, from about 0.4% to about 0.6% by weight iron, from about 0.5% by weight to about 0.7% by weight iron, from about 0.6% by weight to about 0.8% by weight iron, from about 0.7% by weight to about 0.9% by weight iron, from about 0.8% by weight to about 1% by weight iron, or from about 0.9% by weight iron to about 1.1% by weight iron.

In still other examples, the metallic material 104 can be comprised of from about 90% by weight to about 97% by weight aluminum, from about 2% by weight to about 8% by weight silicon, and no greater than about 2% by weight of one or more additional components with the one or more additional components comprising at least one of magnesium, iron, titanium, copper, manganese, nickel, strontium, gallium, vanadium, chromium, or zinc. In various additional examples, the metallic material 104 can be comprised of an A356 aluminum alloy with or without added amounts of iron.

In at least some examples, the metallic material 104 can be free of grain refiners that are additives that can act as nucleation sites of the metallic material 104. In one or more illustrative examples, the metallic material 104 can be free of grain refiners that include at least one of boron or titanium.

In one or more examples, in implementations where the metallic material 104 is comprised of an aluminum alloy, the metallic material 104 can have a melting temperature that is at least about 500° C., at least about 525° C., at least about 550° C., at least about 575° C., at least about 600° C., at least about 625° C., or at least about 650° C. In one or more additional examples, where the metallic material 104 is comprised of an aluminum alloy, the metallic material 104 can have a melting temperature no greater than about 800° C., no greater than about 775° C., no greater than about 750° C., no greater than about 725° C., no greater than about 700° C., or no greater than about 675° C. In one or more illustrative examples, the metallic material 104 can have a melting temperature from about 500° C. to about 800° C., from about 550° C. to about 750° C., from about 500° C. to about 600° C., from about 600° C. to about 700° C., from about 700° C. to about 800° C., from about 500° C. to about 550° C., from about 550° C. to about 600° C., from about 600° C. to about 650° C., from about 650° C. to about 700° C., from about 700° C. to about 750° C., or from about 750° C. to about 800° C.

In various examples, that amount of the metallic material 104 being heated can be at least about 50 grams (g), at least about 100 g, at least about 250 g, at least about 500 g, at least about 750 g, at least about 1 kilogram (kg), at least about 5 kg, at least about 10 kg, at least about 15 kg, at least about 20 kg, at least about 25 kg, at least about 30 kg, at least about 35 kg, at least about 40 kg, at least about 45 kg, at least about 50 kg, at least about 55 kg, or at least about 60 kg. The amount of metallic material 104 being heated can be no greater than about 200 kg, no greater than about 190 kg, no greater than about 180 kg, no greater than about 170 kg, no greater than about 160 kg, no greater than about 150 kg, no greater than about 140 kg, no greater than about 130 kg, no greater than about 120 kg, no greater than about 110 kg, no greater than about 100 kg, no greater than about 90 kg, or no greater than about 80 kg. In one or more illustrative examples, the amount of the metallic material 104 being heated can be from about 50 g to about 200 kg, from about 1 kg to about 100 kg, from about 10 kg to about 80 kg, from about 50 g to about 1 kg, from about 100 g to about 800 g, from about 1 kg to about 100 kg, from about 100 kg to about 200 kg, from about 10 kg to about 50 kg, from about 50 kg to about 100 kg, from about 100 kg to about 150 kg, from about 150 kg to about 200 kg, from about 1 kg to about 20 kg, from about 10 kg to about 30 kg, from about 20 kg to about 40 kg, from about 30 kg to about 50 kg, from about 40 kg to about 60 kg, from about 50 kg to about 70 kg, from about 60 kg to about 80 kg, from about 70 kg to about 90 kg, from about 80 kg to about 100 kg, from about 90 kg to about 110 kg, from about 100 kg to about 120 kg, from about 110 kg to about 130 kg, from about 120 kg to about 140 kg, from about 130 kg to about 150 kg, from about 140 kg to about 160 kg, from about 150 kg to about 170 kg, from about 160 kg to about 180 kg, from about 170 kg to about 190 kg, or from about 180 kg to about 200 kg.

The process 100 can also include, at 110, placing the liquid metallic material 106 into a container 112. The container 112 can include a mold, die, or other vessel that has a given shape. In one or more examples, the shape of the container 112 can be relatively simple. For example, the container 112 can have at least one of one or more square shapes, one or more rectangular shapes, one or more circular shapes, one or more ellipsoidal shapes, or one or more polygonal shapes. In one or more additional examples, the container 112 can have a relatively complex shape with curves, bends, corners such that it has a different cross-sectional shape and size at different locations. To illustrate, the container 112 can have a shape that is a composite of a number of different parts. In one or more illustrative examples, the container 112 can be used in a giga-casting or a mega-casting process. In these scenarios, the container 112 can include a mold for an undercarriage of a vehicle. The container 112 can have a shape that corresponds to a shape of one or more articles that are being produced using the metallic material 104.

The container 112 can include one or more sidewalls 114. One or more openings 116 can be formed in the one or more sidewalls 114. The container 112 can be comprised of one or more materials having a melting point that is greater than a melting point of the liquid metallic material 106. In one or more examples, the container 112 can be comprised of one or more metallic materials. In at least some examples, the container 112 can be comprised of at least about 50% by weight of one or more metallic materials. For example, the container 112 can be comprised of a steel. To illustrate, the container 112 can be comprised of a carbon steel or a stainless steel. In one or more additional examples, the container 112 can be comprised of at least one of one or more iron-containing materials or one or more alloys of aluminum. In one or more additional materials, the container 112 can be comprised of one or more non-metallic materials. In various examples, the container 112 can be comprised of at least about 50% by weight of one or more silicon-based materials, one or more ceramic materials, or one or more polymeric materials. In one or more illustrative examples, the container 112 can be comprised of graphite. In one or more additional illustrative examples, the materials used to form the container 112 can be designed based on the melting point and composition of the liquid metallic material 106.

The process 100 can include, at 118, placing a sonication device 120 into a sidewall 114 of the container 112. For example, the sonication device 120 can be placed into the opening 116. Although the illustrative example of FIG. 1 indicates that the sonication device 120 is placed in the opening 116 after adding the liquid metallic material 106 to the container 112, in one or more additional implementations, the sonication device 120 can be placed in the opening 116 before the liquid metallic material 106 is disposed in the container 112. The dimensions of the opening 116 can correspond to the dimensions of the sonication device 120 such that the sonication device 120 can vibrate within the opening 116 and such that an amount of liquid metallic material 106 moving into the opening 116 while the sonication device 120 is inserted into the opening 116 is minimized or eliminated. Additionally, the sonication device 120 can be comprised of materials having a melting point that is greater than the melting point of the metallic material 104. For example, when using an aluminum alloy, the sonication device 120 can be made of an alloy of titanium commonly known as Ti-6Al-4V, In this way, contamination of the liquid metallic materials 106 from the sonication device 120 can be avoided.

In one or more examples, the sonication device 120 can be placed at least substantially flush with an interior wall of a cavity of the container 112. For example, the sonication device 120 can be placed to minimize contact between the sonication device 120 and the amount of metallic materials 124 disposed in the container 112. Additionally, the sonication device 120 can be placed within the opening 116 such that the sonication device 120 is set back from a portion of the opening 116 in the interior wall of the container 112. To illustrate, the sonication device 120 can be placed from about 0.1 mm to about 3 mm, from about 0.1 mm to about 2 mm, from about 0.1 mm to about 1 mm, or from about 0.5 mm to about 2 mm from a portion of the opening 116 formed in the interior wall of the container 112. In still other examples, the sonication device 120 can be placed within a portion of the container 112 that is proximate to the opening 116. In one or more illustrative examples, the sonication device 120 can be placed from about 0.02 mm to about 5 mm, from about 0.1 mm to about 3 mm, from about 0.1 mm to about 1 mm, or from about 0.5 mm to about 2 mm within the container 112 that is proximate to the opening 116. In at least some examples, the sonication device 120 can be placed within the container 112 such that the sonication device 120 is not permanently embedded within the amount of metallic material 124 when the amount of metallic material 124 cools. In various examples, the amount of metallic material 124 can shrink as it cools. In these scenarios, the sonication device 120 can be progressively placed further in the container 112 during the cooling process of the amount of metallic material 120 such that the sonication device 120 does not contact or minimally contacts the amount of metallic material 120 as the amount of metallic material 124 cools.

At 122, the process 100 can include applying sound energy to a portion of an amount of metallic material 124 disposed in the container 112. To illustrate, the sonication device 120 can deliver sound energy to the amount of metallic material 124 within the container 112. In one or more examples, the sonication device 120 can deliver sound energy having one or more frequencies and one or more amplitudes. In at least some examples, the one or more frequencies of the sound energy delivered to the amount of metallic material 124 can be based on dimensions of the sonication device 120. For example, the one or more frequencies of the sound energy delivered to the liquid metallic material 106 can be based on a diameter, length, other aspects of geometry, and material of the sonication device 120. Additionally, the one or more amplitudes of the sound energy delivered to the amount of metallic material 124 can be based on an amount of power being supplied to the sonication device 120. In various examples, at least one of the one or more frequencies or the one or more amplitudes of the sound energy delivered by the sonication device 120 can be based on one or more settings of the sonication device 120. In one or more illustrative examples, at least one of the frequency, amplitude, or power used to produce the sound energy applied by the sonication device 120 to the region of the amount of metallic material 124 can be relatively constant. In one or more additional illustrative examples, at least one of the frequency, amplitude, or power used to produce the sound energy applied by the sonication device 120 to a region of the amount of metallic material 124 can be varied over at least a portion of the period of time that the sound energy is applied to the region.

In one or more illustrative examples, the sonication device 120 can apply sound energy to a region of the amount of metallic material 124 having a frequency from about 1 kilohertz (kHz) to about 100 kHz, from about 10 kHz to about 80 kHz, from about 20 kHz to about 60 kHz, from about 1 kHz to about 50 kHz, from about 50 kHz to about 100 kHz, from about 5 kHz to about 25 kHz, from about 10 kHz to about 30 kHz, from about 15 kHz to about 35 kHz, from about 20 kHz to about 40 kHz, from about 25 kHz to about 45 kHz, from about 30 kHz to about 50 kHz, from about 5 kHz to about 15 kHz, from about 10 kHz to about 20 kHz, from about 15 kHz to about 25 kHz, from about 20 kHz to about 30 kHz, from about 25 kHz to about 35 kHz, from about 30 kHz to about 40 kHz, from about 35 kHz to about 45 kHz, or from about 40 kHz to about 50 kHz.

Additionally, an amplitude of the sound energy applied to a region of the amount of metallic material 124 can be from about 5 micrometers (μm) to about 210 μm, from about 10 μm to about 180 μm, from about 50 μm to about 150 μm, from about 10 μm to about 100 μm, from about 10 μm to about 50 μm, from about 50 μm to about 100 μm, from about 100 μm to about 150 μm, from about 150 μm to about 200 μm, from about 10 μm to about 30 μm, from about 30 μm to about 50 μm, from about 50 μm to about 70 μm, from about 70 μm to about 90 μm, from about 90 μm to about 110 μm, from about 110 μm to about 130 μm, from about 130 μm to about 150 μm, from about 150 μm to about 170 μm, from about 170 μm to about 190 μm, or from about 190 μm to about 210 μm.

Further, an amount of power applied to cause the sonication device 120 to produce the sound energy applied to a region of the amount of metallic material 124 can be from about 5 Watts (W) to about 5000 W, from about 10 W to about 2500 W, from about 25 W to about 1000 W, from about 100 W to about 500 W, from about 500 W to about 1000 W, from about 1000 W to about 1500 W, from about 1500 W to about 2000 W, from about 2000 W to about 2500 W, from about 2500 W to about 3000 W, from about 3000 W to about 3500 W, from about 3500 W to about 4000 W, from about 4000 W to about 4500 W, from about 4500 W to about 5000 W, from about 50 W to about 250 W, from about 250 W to about 500 W, from about 500 W to about 750 W, from about 750 W to about 1000 W, from about 1000 W to about 1250 W, from about 1250 W to about 1500 W, from about 1500 W to about 1750 W, from about 1750 W to about 2000 W, from about 2000 W to about 2250 W, from about 2250 W to about 2500 W, from about 2500 W to about 2750 W, from about 2750 W to about 3000 W, from about 3000 W to about 3250 W, from about 3250 W to about 3500 W, from about 3500 W to about 3750 W, from about 3750 W to about 4000 W, from about 4000 W to about 4250 W, from about 4250 W to about 4500 W, from about 4500 W to about 4750 W, or from about 4750 W to about 5000 W.

The sonic energy can be applied to the amount of metallic material 124 by the sonication device 120 for a period of time. In one or more examples, sonic energy can be applied to the amount of metallic material 124 by the sonication device 120 while the amount of metallic material 124 cools within the container 112. In at least some examples, sonic energy can be applied to the amount of metallic material 124 by the sonication device 120 as the amount of metallic material 124 solidifies. In various examples, portions of the amount of the metallic material 120 may not cool at a uniform rate. For example, one or more portions of the amount of metallic material 120 can fall below the solidus of the metallic material at different times. In at least some examples, the cooling rate of the amount of metallic material 124 disposed in the container 112 can be modified by at least one of heating or cooling an environment in which the container 112 is located. Additionally, the cooling rate of the amount of metallic material 124 disposed in the container 112 can be modified based on at least one of heating or cooling the container 112. In still other examples, sonic energy can be applied to the metallic material 124 by the sonication device 120 while the amount of metallic material 124 is in a liquid state within the container 112 and before the amount of metallic material 124 begins to solidify. In these scenarios, at least a portion of the amount of metallic material 124 can solidify without sonic energy being applied by the sonication device 120.

In one or more examples, sonic energy can be applied to the amount of metallic material 124 by the sonication device 120 while a temperature of at least a portion of the amount of metallic material 124 has dropped below the solidus of the metallic material. In one or more additional examples, sonic energy can be applied by the sonication device 120 to the amount of metallic material 124 until the temperature of one or more regions of the amount of metallic material 124 drops below the solidus of the metallic material. In one or more illustrative examples, sonic energy can be applied to the amount of metallic material 124 by the sonication device 120 until a temperature of the region of the amount of metallic material 124 proximate to the location of the sonication device 120 drops below the solidus of the metallic material. The temperature of one or more portions of the amount of metallic material 124 can be monitored using one or more temperature probes located in or proximate to one or more locations of the amount of metallic material 124 disposed in the container 112.

In one or more additional illustrative examples, a cooling rate of the amount of metallic material 124 disposed in the container can be from about 0.1° C./second to about 50° C./second, from about 0.5° C./second to about 25° C./second, from about 1° C./second to about 10° C./second, from about 3° C./second to about 5° C./second, or from about 5° C./second to about 7° C./second. In at least some examples, the amount of metallic material 124 disposed in the container 112 can have a pre-eutectic cooling rate and a post-eutectic cooling rate. In one or more further illustrative examples, the amount of metallic material 124 disposed in the container 112 can have a pre-eutectic cooling rate from about 2° C./second to about 8° C./second, from about 3° C./second to about 7° C./second, or from about 4° C./second to about 6° C./second. In at least some examples, the amount of metallic materials 124 disposed in the container 112 can have a post-eutectic cooling rate from about 0.5° C./second to about 3° C./second or from about 0.8° C./second to about 2° C./second.

In various examples, sonic energy can be applied to a portion of the amount of metallic material 124 disposed in the container 112 for a duration from about 30 seconds to about 60 minutes, from about 1 minute to about 45 minutes, from about 5 minutes to about 30 minutes, from about 1 minute to about 20 minutes, from about 10 minutes to about 30 minutes, from about 20 minutes to about 40 minutes, from about 30 minutes to about 50 minutes, from about 40 minutes to about 60 minutes, from about 1 minute to about 10 minutes, from about 5 minutes to about 15 minutes, from about 10 minutes to about 20 minutes, from about 15 minutes to about 25 minutes, from about 20 minutes to about 30 minutes, from about 25 minutes to about 35 minutes, from about 30 minutes to about 40 minutes, from about 35 minutes to about 45 minutes, from about 40 minutes to about 50 minutes, from about 45 minutes to about 55 minutes or from about 50 minutes to about 60 minutes.

The process 100 can include, at 126, removing an object 128 comprised of the metallic material 104 from the container 112. The object 128 can have a shape of the container 112. In various examples, the object 128 can be a finally-formed object. For example, the object 128 may not be subject to one or more additional shaping operations after being removed from the container 112. In at least some examples, the object 128 can undergo one or more heat treatments after being removed from the container 112. The one or more heat treatments can include performing a number of procedures. In one or more examples, one or more procedures of the one or more heat treatments can include immersing the object 128 in one or more liquids. In one or more examples, the one or more liquids can be used to at least one of heat or cool the object 128. For example, the one or more liquids can be used to heat the object 128 at temperatures from about 100° C. to about 700° C. or from about 200° C. to about 600° C. One or more liquids can also be used to cool the object 128 at temperatures from about 5° C. to about 80° C. or from about 10° C. to about 60° C. In one or more additional illustrative examples, the object 128 can be placed into one or more heating sources, such as a furnace or an oven. In these situations, the object 128 can be heated at temperatures from about 100° C. to about 600° C., from about 100° C. to about 300° C., or from about 100° C. to about 200° C. Individual procedures of the one or more heat treatments can be performed for periods of time from about 5 minutes to about 24 hours, from about 1 hour to about 6 hours, from about 2 hours to about 5 hours, from about 3 hours to about 7 hours, from about 4 hours to about 8 hours, or from about 5 hours to about 9 hours. In one or more further illustrative examples, the one or more heat treatments can include one or more tempering procedures. To illustrate, the one or more heat treatments can include a Temper 6 heat treatment.

The object 128 can include a region 130 that has been modified in response to sound energy being applied to the region 130. In one or more examples, the microstructure of the region 130 can be different from a microstructure of a bulk region 132 of the object 128. In at least some examples, the sizes and/or shape of metallic grains in the region 130 can be different from the sizes and/or shape of metallic grains in the bulk region 132. For example, at least a port of the metallic grains in the region 130 can have a more spherical shape than the metallic grains included in the bulk region 132. Additionally, at least a portion of the metallic grains in the region 130 can have a smaller diameter than the metallic grains included in the bulk region 132. In still other examples, the composition of the components included in the region 130 can be different from the composition of components included in the bulk region 132. For example, one or more additives included in an alloy comprising the metallic material 104 can be found in higher concentrations in the region 130 than in the bulk region 132.

In one or more illustrative examples, the metallic grains of the bulk region 132 can have a dendritic microstructure. In various examples, the metallic grains of the region 130 can have at least one of a globular microstructure or a fine-grained microstructure. In at least some examples, the differences in the grains of the region 130 with respect to the grains of the bulk region 132 can result in enhanced physical properties of the region 130 with respect to the bulk region 132. To illustrate, at least one of the strength, ductility, or fatigue life of the region 130 can be increased with respect to at least one of the strength, ductility, or fatigue life of the bulk region 132.

In various examples, the object 128 can comprise one or more parts used in the automotive industry. For examples, the object 128 can comprise one or more parts of an engine block, an engine cylinder, or a transmission housing. In still other examples, the object 128 can comprise one or more parts of a body or supporting structure of a vehicle, such as a reinforcement side member, an underbody, a tank cover frame, a floor reinforcement, a frame rail, a cross member, a B-pillar, and/or a shock tower. The object can also be a casting that is used in non-automotive industry, e.g., cover of an electric motor and so forth.

Figure 2:
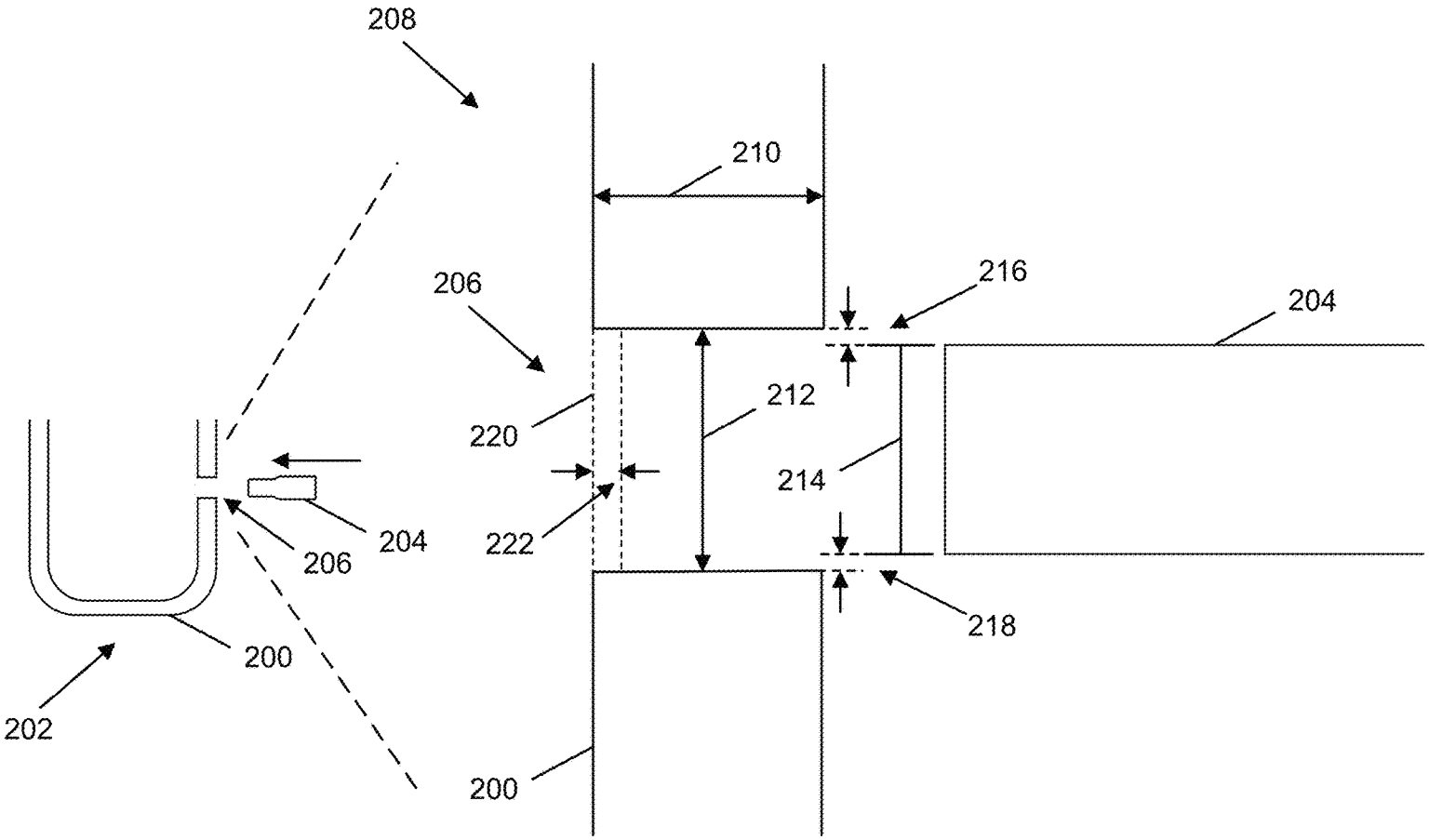
FIG. 2 illustrates modifications to a wall of a mold in relation to a sonication probe that is inserted into the wall of the mold, in accordance with one or more examples.

FIG. 2 illustrates modifications to a wall 200 of a container 202 in relation to a sonication device 204 that is inserted into the wall 200 of the container 202, in accordance with one or more examples. The wall 200 can include an opening 206 in which the sonication device 204 can be placed. In one or more illustrative examples, the container 202 can correspond to the container 112 described in relation to FIG. 1, the sonication device 204 can correspond to the sonication device 120 described in relation to FIG. 1, and the opening 206 can correspond to the opening 116 described in relation to FIG. 1.

The illustrative example of FIG. 2 includes an expanded view 208 of the portion of the wall 200 proximate to the opening 206. The opening 206 can have a width 210. The width 210 can be from about 2 millimeters (mm) to about 100 mm, from about 5 mm to about 50 mm, from about 10 mm to about 30 mm, from about 5 mm to about 25 mm, from about 20 mm to about 40 mm, from about 30 mm to about 50 mm, from about 40 mm to about 60 mm, from about 50 mm to about 70 mm, from about 60 mm to about 80 mm, from about 70 mm to about 90 mm, or from about 80 mm to about 100 mm. In one or more additional examples, the width 210 of the wall 200 can be from about 1 mm to about 5 centimeters (cm), from about 100 mm to about 4 cm, from about 1 cm to about 3 cm, from about 0.5 cm to about 2.5 cm, from about 1.5 cm to about 3.5 cm, from about 2 cm to about 4 cm, from about 2.5 cm to about 4.5 cm, or from about 3 cm to about 5 cm.

The opening 206 can also have a height 212. The height 212 can correspond to and be larger than a diameter 214 of the sonication device 204. In one or more examples, the height 212 can be from about 1 mm to about 6 mm, from about 2 mm to about 30 mm, from about 5 mm to about 25 mm, from about 2 mm to about 12 mm, from about 4 mm to about 14 mm, from about 6 mm to about 16 mm, from about 8 mm to about 18 mm, from about 10 mm to about 20 mm, from about 1 mm to about 5 mm, from about 2 mm to about 6 mm, from about 3 mm to about 7 mm, from about 4 mm to about 8 mm, from about 5 mm to about 9 mm, from about 6 mm to about 10 mm, from about 7 mm to about 11 mm, from about 8 mm to about 12 mm, from about 9 mm to about 13 mm, from about 10 mm to about 14 mm, from about 11 mm to about 15 mm, from about 12 mm to about 16 mm, from about 13 mm to about 17 mm, from about 14 mm to about 18 mm, from about 15 mm to about 19 mm, from about 16 mm to about 20 mm, from about 17 mm to about 21 mm, from about 18 mm to about 22 mm, from about 19 mm to about 23 m, from about 20 mm to about 24 mm, from about 21 mm to about 25 mm, from about 22 mm to about 26 mm, from about 23 mm to about 27 mm, or from about 24 mm to about 28 mm.

In at least some examples, the height 212 of the opening 206 can be at least about 1.01 times the diameter 214 of the sonication device 204, at least about 1.02 times the diameter 214 of the sonication device 204, at least about 1.03 times the diameter 214 of the sonication device 204, at least about 1.04 times the diameter 214 of the sonication device 204, at least about 1.05 times the diameter 214 of the sonication device 204, at least 1.06 times the diameter 214 of the sonication device 204, at least 1.07 time the diameter 214 of the sonication device 204*s*, at least 1.08 times the diameter 214 of the sonication device 204, at least 1.09 times the diameter 214 of the sonication device 204, at least 1.1 times the diameter 214 of the sonication device 204, at least 1.12 times the diameter 214 of the sonication device 204, at least 1.14 times the diameter 214 of the sonication device 204, at least 1.16 times the diameter 214 of the sonication device 204, at least 1.18 times the diameter 214 of the sonication device 204 or at least about 1.20 times the diameter 214 of the sonication device 204. In one or more illustrative examples, the height 212 of the opening 206 can be from about 1.01 times to about 1.5 times the diameter 214 of the sonication device 204, from about 1.05 times to about 1.4 times the diameter 214 of the sonication device 204, from about 1.1 times to about 1.3 times the diameter 214 of the sonication device 204, from about 1.02 times to about 1.08 times the diameter 214 of the sonication device 204, from about 1.04 times to about 1.1 times the diameter 214 of the sonication device 204, from about 1.06 times to about 1.12 times the diameter 214 of the sonication device 204, from about 1.08 times to about 1.14 times the diameter 214 of the sonication device 204, from about 1.1 times to about 1.16 times the diameter 214 of the sonication device 204, from about 1.12 times to about 1.18 times the diameter 214 of the sonication device 204, from about 1.14 times to about 1.2 times the diameter 214 of the sonication device 204, from about 1.16 times to about 1.22 times the diameter 214 of the sonication device 204, from about 1.18 times to about 1.24 times the diameter 214 of the sonication device 204, from about 1.2 times to about 1.26 times the diameter 214 of the sonication device 204, from about 1.22 times to about 1.28 times the diameter 214 of the sonication device 204, or from about 1.24 times to about 1.3 times the diameter 214 of the sonication device 204.

In various examples, a tolerance can be present that corresponds to a difference in the height of the opening 206 and the diameter 214 of the sonication device 204. The tolerance can provide sufficient space for the sonication device 204 to vibrate while inserted into the opening 206. In one or more examples, the tolerance can be characterized by at least one of a first distance 216 or a second distance 218. In at least some examples, the first distance 216 and the second distance 218 can be substantially the same. In one or more additional examples, the first distance 216 and the second distance 218 can be different. For example, a value of the first distance 216 can be at least about 5% different, at last about 8% different, at least about 10% different, at least about 12% different, or at least about 15% different from the second distance 218. At least one of the first distance 216 or the second distance 218 can be from about 0.01 mm to about 5 mm, from about 0.05 mm to about 3 mm, from about 0.1 mm to about 1 mm, from about 0.01 mm to about 0.1 mm, from about 0.1 mm to about 0.2 mm, from about 0.2 mm to about 0.3 mm, from about 0.3 mm to about 0.4 mm, from about 0.4 mm to about 0.5 mm, from about 0.5 mm to about 0.6 mm, from about 0.6 mm to about 0.7 mm, from about 0.7 mm to about 0.8 mm, from about 0.8 mm to about 0.9 mm, or from about 0.9 mm to about 1 mm.

In one or more examples, the opening 206 can extend through the wall 200 of the container 202 such that the opening 206 is a through hole within the wall 200. In these scenarios, the opening 206 can be in fluid communication with a cavity of the container 202. In one or more additional examples, a remainder portion 220 of the wall 200 can be present such that a first end of the opening 206 is clear and that a second end of the opening 206 proximate to a cavity of the container 202 is closed. For example, the first end of the opening 206 in which the sonication device 204 is inserted can be free of the material used to form the container 202 and the second end of the opening 206 proximate to a cavity of the container 202 can be closed by the remainder portion 220. In these scenarios, the remainder portion 220 can have a width 222 that is no greater than about 60% of the width 210 of the wall 200, no greater than about 55% of the width of the wall 200, no greater than about 50% of the width 210 of the wall 200, no greater than about 45% of the width 210 of the wall 200, no greater than about 40% of the width 210 of the wall 200, no greater than about 35% of the width 210 of the wall 200, no greater than about 30% of the width 210 of the wall 200, no greater than about 25% of the width 210 of the wall 200, no greater than about 20% of the width 210 of the wall 200, no greater than about 15% of the width 210 of the wall 200, no greater than about 10% of the width 210 of the wall 200, or no greater than about 5% of the width 210 of the wall 200. In one or more illustrative examples, the remainder portion 220 can have a width 222 from about 0.1 mm to about 10 mm, from about 0.2 mm to about 5 mm, from about 0.5 mm to about 3 mm, from about 1 mm to about 3 mm, from about 2 mm to about 4 mm, from about 3 mm to about 5 mm, from about 0.1 mm to about 1 mm, from about 0.2 mm to about 1.2 mm, from about 0.4 mm to about 1.4 mm, from about 0.6 mm to about 1.6 mm, from about 0.8 mm to about 1.8 mm, from about 1 mm to about 2 mm, from about 2 mm to about 3 mm, from about 3 mm to about 4 mm, or from about 4 mm to about 5 mm.

Figure 3:
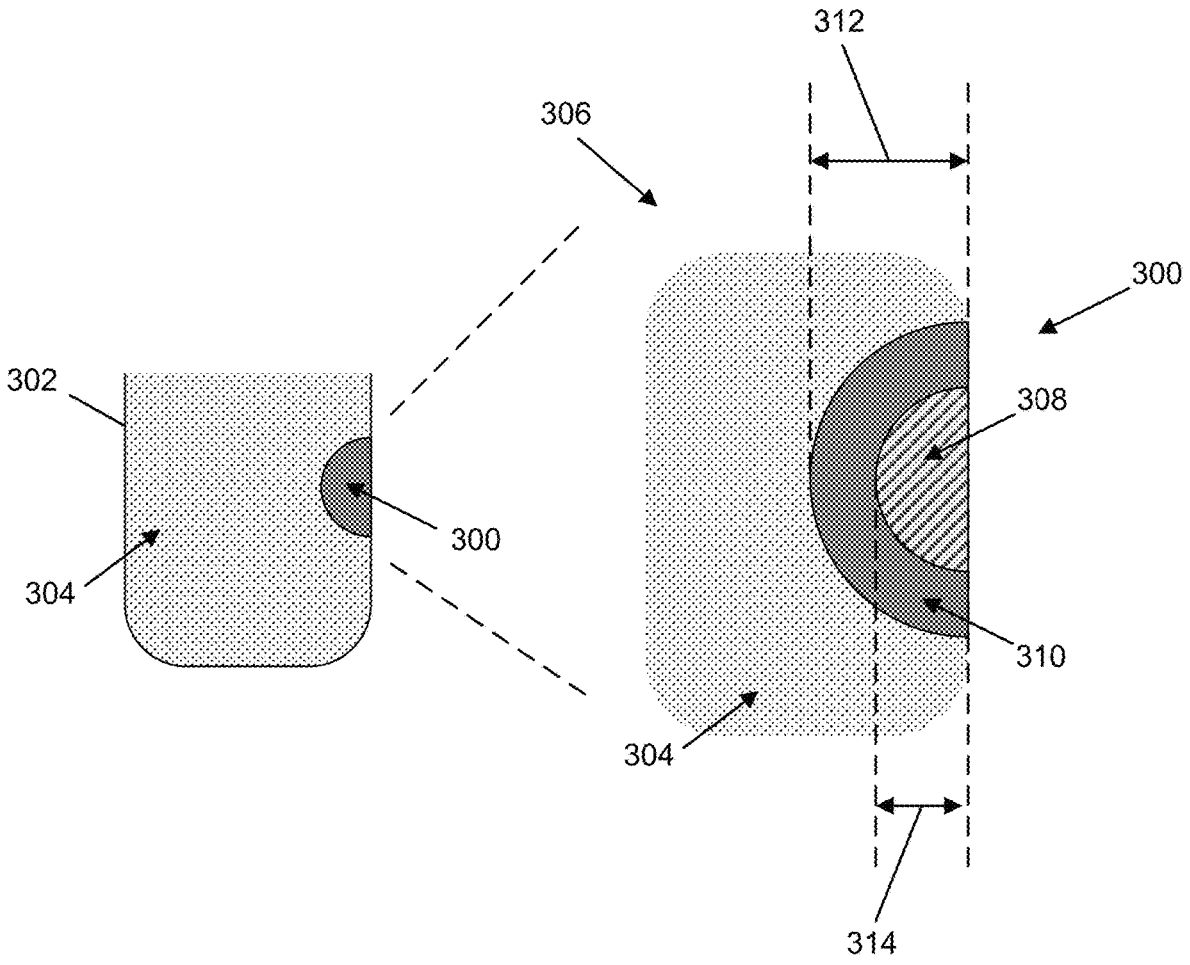
FIG. 3 illustrates a region at a location of an object that has been modified in response to sonication being applied to the location of the object, in accordance with one or more examples.

FIG. 3 illustrates a region 300 at a location of an object 302 that has been modified in response to sonication being applied to the location of the object 302, in accordance with one or more examples. The region 302 can have a different microstructure with respect to a bulk region 304 of the object 302. In various examples, the region 300 can be formed according to implementations of the process 100 described in relation to FIG. 1.

The illustrative example of FIG. 3 includes an expanded view 306 of a portion of the object 302 that includes the region 300 and a portion of the bulk region 304. In the illustrative example of FIG. 3, the region 300 includes a first subregion 308 and a second subregion 310. The first subregion 308 and the second subregion 310 can have different microstructures with respect to the microstructure of the bulk region 304. Additionally, the first subregion 308 can have a different microstructure than a microstructure of the second subregion 310. In one or more illustrative examples, the bulk region 304 can have a dendritic microstructure. In one or more additional illustrative examples, the first subregion 308 can have a fine-grained microstructure. In one or more further illustrative examples, the second subregion 310 can have a globular microstructure.

Although the illustrative example of FIG. 3 shows the first subregion 308 and the second subregion 310 having respective shapes, locations, and areas, in one or more additional examples, the first subregion 308 and the second subregion 310 can have a variety of shapes, locations, and area. In various examples, the first subregion 308 can be located within the second subregion 310 and, in other scenarios, a portion of the first subregion 308 can be located bordering the bulk region 304 and an additional portion of the first subregion 308 can be located bordering the second subregion 310. In at least some examples, the first subregion 308 and the second subregion 310 are formed in portions of the object 302 that are located proximate to a placement of a sonication device that applied sound energy to the object 302 during formation of the object 302 within a container.

The equivalent grain size of grains of a primary component included in the first subregion 308 can be from about 8 times to about 15 times smaller than the equivalent grain size of grains of the primary component included in the bulk region 304, from about 10 times to about 14 times smaller than the equivalent grain size of grains of the primary component included in the bulk region 304, from about 8 times to about 12 times smaller than the equivalent grain size of grains of the primary component included in the bulk region 304, from about 10 times to about 14 times smaller than the equivalent grain size of grains of the primary component included in the bulk region 304, from about 12 times to about 15 times smaller than the equivalent grain size of grains of the primary component included in the bulk region 304, from about 8 times to about 10 times smaller than the equivalent grain size of grains of the primary component included in the bulk region 304, from about 10 times to about 12 times smaller than the equivalent grain size of grains of the primary component included in the bulk region 304, or from about 12 times to about 15 times smaller than the equivalent grain size of grains of the primary component included in the bulk region 304. Additionally, the equivalent grain size of grains of the primary component included in the second subregion 310 can be from about 2 times to about 9 times smaller than the equivalent grain size of grains of the primary component included in the bulk region 304, from about 3 times to about 8 times smaller than the equivalent grain size of grains of the primary component included in the bulk region 304, from about 2 times to about 4 times smaller than the equivalent grain size of grains of the primary component included in the bulk region 304, from about 4 times to about 6 times smaller than the equivalent grain size of grains of the primary component included in the bulk region 304, or from about 6 times to about 9 times smaller than the equivalent grain size of grains of the primary component included in the bulk region 304. In one or more illustrative examples, the equivalent grain size can estimate the grain size of the primary component when the grains are perfect circles. The equivalent grain size can be determined according to the formula:

$$\text{Equivalent Grain Size} = \sqrt{4A/\pi},$$

where A=the grain area estimated by the number of pixels corresponding to a given grain.

Additionally, a sphericity of grains of the primary component included in the first subregion 308 can be from about 25% to about 44%, from about 30% to about 40%, from about 25% to about 35%, from about 30% to about 40%, from about 35% to about 44%, from about 25% to about 30%, from about 30% to about 35%, from about 35% to about 40%, or from about 40% to about 44% greater on average than a sphericity of grains of the primary component included in the bulk region 304. Further, a sphericity of grains of the primary component included in the second subregion 310 can be from about 23% to about 45%, from about 25% to about 40%, from about 25% to about 30%, from about 30% to about 35%, from about 35% to about 40%, or from about 40% to about 45% greater on average than a sphericity of grains of the primary component included in the bulk region 304.

In one or more illustrative examples, the grains of the primary component can refer to particles of a metallic material comprising greater than 50% by weight of the object 302. For example, in scenarios where the object 302 is comprised of an aluminum alloy, the primary component can be aluminum. In one or more additional examples where the object 302 is comprised of a steel, the primary component can be iron. In one or more further examples where the object 302 is comprised of an alloy of copper, the primary component can be copper.

In various examples, grains of a primary component of the bulk region 304 can have aspect ratios on average from about 1.7 to about 3.1, from about 1.8 to about 2.8, from about 2.0 to about 2.6, from about 1.7 to about 1.9, from about 1.9 to about 2.1, from about 2.1 to about 2.3, from about 2.3 to about 2.5, from about 2.5 to about 2.7, from about 2.7 to about 2.9, or from about 2.9 to about 3.1. In addition, grains of a primary component of the first subregion 308 can have aspect ratios on average from about 1.7 to about 1.9, from about 1.72 to about 1.88, from about 1.74 to about 1.86, from about 1.76 to about 1.84, or from about 1.78 to about 1.82. Further, grains of a primary component of the second subregion can have aspect ratios on average from about 1.4 to about 1.6, from about 1.42 to about 1.58, from about 1.44 to about 1.56, from about 1.46 to about 1.54, or from about 1.48 to about 1.52.

In still other examples, grains of a primary component of the bulk region 304 can have mean equivalent diameters from about 50 μm to about 1800 μm, from about 100 μm to about 1500 μm, from about 200 μm to about 400 μm, from about 400 μm to about 600 μm, from about 600 μm to about 800 μm, from about 800 μm to about 1000 μm, from about 1000 μm to about 1200 μm, from about 1200 μm to about 1400 μm, from about 1400 μm to about 1600 μm, or from about 1600 μm to about 1800 μm. Additionally, grains of a primary component of the first subregion 308 can have mean equivalent diameters from about 3 μm to about 50 μm, from about 10 μm to about 40 μm, from about 3 μm to about 25 μm, from about 10 μm to about 30 μm, from about 15 μm to about 35 μm, from about 20 μm to about 40 μm, from about 25 μm to about 45 μm, from about 30 μm to about 50 μm, from about 3 μm to about 15 μm, from about 10 μm to about 20 μm, from about 15 μm to about 25 μm, from about 20 μm to about 30 μm, from about 25 μm to about 35 μm, from about 30 μm to about 40 μm, from about 35 μm to about 45 μm, or from about 40 μm to about 50 μm. Further, grains of a primary component of the second subregion 310 can have mean equivalent diameters from about 15 μm to about 80 μm, from about 20 μm to about 70 μm, from about 30 μm to about 60 μm, from about 15 μm to about 35 μm, from about 20 μm to about 40 μm, from about 25 μm to about 45 μm, from about 30 μm to about 50 μm, from about 35 μm to about 55 μm, from about 40 μm to about 60 μm, from about 45 μm to about 65 μm, from about 50 μm to about 70 μm, from about 55 μm to about 75 μm, from about 60 μm to about 80 μm, from about 15 μm to about 25 μm, from about 20 μm to about 30 μm, from about 25 μm to about 35 μm, from about 30 μm to about 40 μm, from about 35 μm to about 45 μm, from about 40 μm to about 50 μm, from about 45 μm to about 55 μm, from about 50 μm to about 60 μm, from about 55 μm to about 65 μm, from about 60 μm to about 70 μm, from about 65 μm to about 75 μm, or from about 70 μm to about 80 μm.

In various examples, one or more portions of the first subregion 308 can extend from about 0.2 mm to about 5 mm, from about 0.5 mm to about 4 mm, from about 1 mm to about 3 mm, from about 0.2 mm to about 1.2 mm, from about 0.4 mm to about 1.4 mm, from about 0.6 mm to about 1.6 mm, from about 0.8 mm to about 1.8 mm, from about 1 mm to about 2 mm, or from about 1.5 mm to about 2.5 mm from a boundary of the object 302 that forms at least a portion of the region 300. In one or more additional examples, one or more portions of the second subregion 310 can extend from about 3 mm to about 60 mm, from about 5 mm to about 50 mm, from about 10 mm to about 40 mm, from about 5 mm to about 25 mm, from about 10 mm to about 30 mm, from about 15 mm to about 35 mm, from about 20 mm to about 40 mm, from about 25 mm to about 45 mm, from about 30 mm to about 50 mm, from about 35 mm to about 55 mm, from about 40 mm to about 60 mm, from about 5 mm to about 15 mm, from about 10 mm to about 20 mm, from about 15 mm to about 25 mm, from about 20 mm to about 30 mm, from about 25 mm to about 35 mm, from about 30 mm to about 40 mm, from about 35 mm to about 45 mm, from about 40 mm to about 50 mm, from about 45 mm to about 55 mm, or from about 50 mm to about 60 mm from a boundary of the object 302 that forms at least a portion of the region 300.

In one or more examples, a combined area of the first subregion 308 and the second subregion 310 can be from about 40 $mm^2$ to about 2000 $mm^2$, from about 50 $mm^2$ to about 1500 $mm^2$, from about 80 $mm^2$ to about 1000 $mm^2$, from about 100 $mm^2$ to about 500 $mm^2$, from about 50 $mm^2$ to about 100 $mm^2$, from about 50 $mm^2$ to about 150 $mm^2$, from about 150 $mm^2$ to about 250 $mm^2$, from about 250 $mm^2$ to about 350 $mm^2$, from about 350 $mm^2$ to about 450 $mm^2$, from about 450 $mm^2$ to about 550 $mm^2$, from about 550 $mm^2$ to about 650 $mm^2$, from about 650 $mm^2$ to about 750 $mm^2$, from about 750 $mm^2$ to about 850 $mm^2$, from about 850 $mm^2$ to about 1000 $mm^2$, from about 1000 $mm^2$ to about 1100 $mm^2$, from about 1100 $mm^2$ to about 1200 $mm^2$, from about 1200 $mm^2$ to about 1300 $mm^2$, from about 1400 $mm^2$ to about 1500 $mm^2$, from about 1500 $mm^2$ to about 1600 $mm^2$, from about 1600 $mm^2$ to about 1700 $mm^2$, from about 1700 $mm^2$ to about 1800 $mm^2$, from about 1800 $mm^2$ to about 1900 $mm^2$, or from about 1900 $mm^2$ to about 2000 $mm^2$.

In one or more additional examples, the amount of one or more secondary components of the metallic material comprising the object 302 can differ between the first subregion 308 and the second subregion 310. For example, an amount of a secondary component of the metallic material comprising the object 302 in the first subregion 308 can be from about 1.2 times to about 4 times, from about 1.5 times to about 3.5 times, from about 2 times to about 3 times, from about 1.2 times to about 2.2 times, from about 1.5 times to about 2.5 times, from about 1.8 times to about 2.8 times, from about 2 times to about 3 times, from about 2.2 times to about 3.2 times, from about 2.5 times to about 3.5 times, from about 2.8 times to about 3.8 times, or from about 3 times to about 4 times the amount of the second component in the second subregion 310. In one or more illustrative examples, the object 302 can be comprised of an alloy of aluminum that includes a secondary component of from about 2% by weight to about 30% by weight silicon, from about 5% by weight to about 20% by weight silicon, from about 2% by weight to about 12% by weight silicon, or from about 4% by weight to about 8% by weight silicon. In these scenarios, the amount of silicon present in the first subregion 308 can be greater than an amount of silicon present in the second subregion 310.

In one or more further examples, the microstructure of grains of one or more secondary components, such as silicon, located in the first subregion 308 and the second subregion 310 can be different from the microstructure of grains of one or more secondary components located in the bulk region 304. To illustrate, grains of a secondary component included in a metallic material comprising the object 302 that are located in the first subregion 308 can have grain equivalent diameters that are from about 20% to about 120%, from about 30% to about 100%, from about 40% to about 80%, from about 20% to about 40%, from about 30% to about 50%, from about 40% to about 60%, from about 50% to about 70%, from about 60% to about 80%, from about 70% to about 90%, from about 80% to about 100%, from about 90% to about 110% or from about 100% to about 120% greater than grain equivalent diameters of the secondary component in the bulk region 304.

In various examples, grains of a secondary component, such as silicon, included in a metallic material comprising the object 302 that are located in the second subregion 310 can have grain equivalent diameters that are from about 1% to about 10%, from about 2% to about 8%, from about 3% to about 7%, from about 1% to about 3%, from about 2% to about 4%, from about 3% to about 5%, from about 4% to about 6%, from about 5% to about 7%, from about 6% to about 8%, from about 7% to about 9%, or from about 8% to about 10% greater than grain equivalent diameters of the secondary component in the bulk region 304.

In at least some examples, grains of a secondary component, such as silicon, included in a metallic material comprising the object 302 located in the first subregion 308 and the second subregion 310 can have an amount of sphericity that is greater than grains of the secondary component located in the bulk region 304. For examples, grains of a secondary component included in a metallic material comprising the object 302 that are located in the first subregion 308 can have a sphericity that is from about 10% to about 80%, from about 20% to about 60%, from about 30% to about 50%, from about 10% to about 20%, from about 15% to about 25%, from about 20% to about 30%, from about 25% to about 35%, from about 30% to about 40%, from about 35% to about 45%, from about 40% to about 50%, from about 45% to about 55%, from about 50% to about 60%, from about 55% to about 65%, from about 60% to about 70%, from about 65% to about 75%, or from about 70% to about 80% greater than grains included in the bulk region 304. In addition, grains of a secondary component included in a metallic material comprising the object 302 that are located in the second subregion 310 can have a sphericity that is from about 10% to about 80%, from about 20% to about 60%, from about 30% to about 50%, from about 10% to about 20%, from about 15% to about 25%, from about 20% to about 30%, from about 25% to about 35%, from about 30% to about 40%, from about 35% to about 45%, from about 40% to about 50%, from about 45% to about 55%, from about 50% to about 60%, from about 55% to about 65%, from about 60% to about 70%, from about 65% to about 75%, or from about 70% to about 80% greater than grains included in the bulk region 304.

In one or more illustrative examples, grains of a secondary component, such as silicon, of the bulk region 304 can have mean equivalent diameters from about 2 μm to about 10 μm, from about 4 μm to about 8 μm, from about 2 μm to about 4 μm, from about 3 μm to about 5 μm, from about 4 μm to about 6 μm, from about 5 μm to about 7 μm, or from about 6 μm to about 8 μm. Additionally, grains of a secondary component of the first subregion 308 can have mean equivalent diameters from about 3 μm to about 15 μm, from about 4 μm to about 12 μm, from about 5 μm to about 10 μm, from about 3 μm to about 6 μm, from about 4 μm to about 7 μm, from about 5 μm to about 8 μm, from about 6 μm to about 9 μm, from about 7 μm to about 10 μm, from about 8 μm to about 11 μm, from about 9 μm to about 12 μm, from about 10 μm to about 13 μm, from about 11 μm to about 14 μm, or from about 12 μm to about 15 μm. Further, grains of a secondary component of the second subregion 310 can have mean equivalent diameters from about 2 μm to about 12 μm, from about 4 μm to about 10 μm, from about 5 μm to about 9 μm, from about 2 μm to about 5 μm, from about 3 μm to about 6 μm, from about 4 μm to about 7 μm, from about 5 μm to about 8 μm, from about 6 μm to about 9 μm, from about 7 μm to about 10 μm, from about 8 μm to about 11 μm, or from about 9 μm to about 12 μm.

In one or more additional illustrative examples, grains of a secondary component, such as silicon, of the bulk region 304 can have sphericity values from about 0.2 to about 0.8, from about 0.3 to about 0.7, from about 0.2 to about 0.4, from about 0.3 to about 0.5, from about 0.4 to about 0.6, from about 0.5 to about 0.7, or from about 0.6 to about 0.8. Additionally, grains of a secondary component of the first subregion 308 can have sphericity values from about 0.3 to about 0.9, from about 0.4 to about 0.8, from about 0.3 to about 0.5, from about 0.4 to about 0.6, from about 0.5 to about 0.7, from about 0.6 to about 0.8, or from about 0.7 to about 0.9. Further, grains of a secondary component of the second subregion 310 can have sphericity values from about 0.3 to about 0.9, from about 0.4 to about 0.8, from about 0.3 to about 0.5, from about 0.4 to about 0.6, from about 0.5 to about 0.7, from about 0.6 to about 0.8, or from about 0.7 to about 0.9.

In at least some examples, one or more additional secondary components included in the metallic material comprising the object 302 can impact the features of the first subregion 308 and features of the second subregion 310. For example, in scenarios where the metallic material comprising the object 302 includes iron, the amount of iron present in the metallic material can affect the area of the first subregion 308 and the area of the second subregion 310. To illustrate, in situations where the metallic material comprising the object 302 is from about 0.5% by weight to about 5% by weight iron, the area of at least one of the first subregion 308 or the second subregion 310 can be greater than in scenarios where the metallic material comprising the object 302 is from about 0.01% by weight to about 0.5% by weight iron.

In one or more additional examples, mean equivalent diameters of grains included in the first subregion 308 of a secondary component, such as silicon, included in a metallic material comprising the object 302 can be larger in scenarios where the amount of iron present in the metallic material is from about 0.5% by weight to about 1.5% by weight in relation to mean equivalent diameters of grains of the secondary component included in the first subregion 308 when the amount of iron present in the metallic material is from about 0.05% by weight to about 0.5% by weight. In one or more further examples, metallic materials comprising the object 302 and having an iron content from about 0.5% by weight to about 1.5% by weight can include a $\beta$-$Al_5FeSi$ phase having particles that are modified within at least one of the first subregion 308 or the second subregion 310 relative to particles of the $\beta$-$Al_5FeSi$ phase located in the bulk region 304. For example, 8-$Al_5FeSi$ particles included in the bulk region 304 can have equivalent mean diameters from about 1 μm to about 6 μm, sphericity values from about 0.05 to about 0.3, and an aspect ratios from about 3 to about 25. Additionally, $\beta$-$Al_5FeSi$ particles included in the first subregion 308 can have equivalent mean diameters from about 0.2 μm to about 4 μm, sphericity values from about 0.1 to about 0.6, and aspect ratios from about 0.5 to about 8. Further, $\beta$-$Al_5FeSi$ particles included in at least a first portion of the second subregion 310 that is closer to the first subregion 308 can have equivalent mean diameters from about 0.2 μm to about 5 μm, sphericity values from about 0.05 to about 0.5, and aspect ratios from about 2 to about 9. In still other scenarios, $\beta$-$Al_5FeSi$ particles included in at least a second portion of the second subregion 310 that is closer to the bulk region 304 can have equivalent mean diameters from about 0.2 μm to about 5 μm, sphericity values from about 0.01 to about 0.2, and aspect ratios from about 5 to about 60.

In at least some examples, the differences in the microstructures of the first subregion 308 and the second subregion 310 in relation to the microstructure of the bulk region 304 can cause at least one of the first subregion 308 or the second subregion 310 to have improved ductility, strength, and fatigue life with respect to the bulk region 304.

Figure 4:
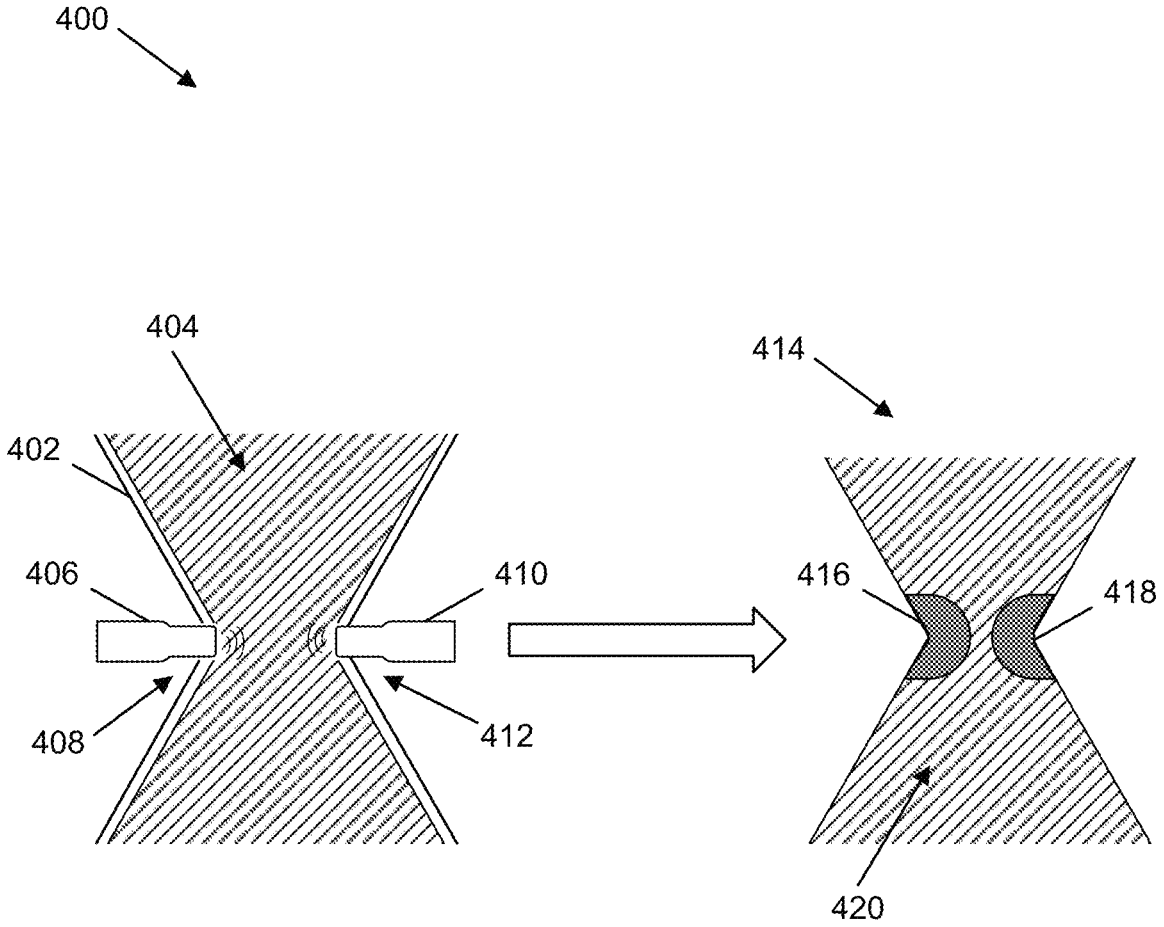
FIG. 4 illustrates applying sonication to multiple portions of a mold and producing an object with multiple regions that have been modified in response to the sonication being applied to the regions, in accordance with one or more examples.

FIG. 4 illustrates a framework 400 to apply sonication to multiple portions of a mold and producing an object with multiple regions that have been modified in response to the sonication being applied to the regions, in accordance with one or more examples. The illustrative example of FIG. 4 includes a container 402 that can be at least a portion of a mold used to form an object. In at least some examples, the container 402 can have a complex shape having a number of corners, edges, or other features. An amount of a liquid metallic material 404 can be disposed in the container 402. Additionally, a first sonication device 406 can be placed at a first location 408 of the container 402 and a second sonication device 410 can be placed at a second location of the container 402.

In one or more illustrative examples, the first location 408 and the second location 412 can correspond to potential points of weakness. In these scenarios, applying sound energy to the first location 408 and the second location 412 can modify the microstructure as the amount of liquid metallic material cools in such a way to improve the physical properties of a formed object 414. To illustrate, the formed object 414 can include a first region 416 and a second region 418 having a different microstructure than a bulk region 420 of the formed object 414. In various examples, the first region 416 and the second region 418 can have a different microstructure in relation to objects formed without applying sound energy to the first location 408 and the second location 412.

In at least some examples, sound energy can be applied to the amount of liquid metallic material 404 in accordance with one or more implementations described with respect to FIG. 1. Additionally, the sonication devices 406, 410 can be placed in openings of one or more walls of the container 402 in accordance with one or more implementations described in relation to FIG. 2. Further, the microstructure of the first region 416 and the second region 418 can correspond to the modified region 300 described in relation to FIG. 3. In various examples, the sound energy applied at the first location 408 by the first sonication device 406 can be applied according to a duration, amplitude, frequency, and power that can be at least substantially the same as the sound energy applied at the second location 412 using the second sonication device 410. In one or more further examples, the sound energy applied at the first location 408 by the first sonication device 406 can be applied according to a duration, amplitude, frequency, and power that is different from the sound energy applied at the second location 412 using the second sonication device 410. In one or more examples, sound energy can be applied differently at the first location 408 and the second location 412 in order to produce different characteristics of the microstructures of the first region 416 and the second region 418. In one or more additional examples, the microstructure of the first region 416 and the second region 418 can be different due to greater or lesser amounts of weakness that may be present in formed objects having the shape of the container 402 that are produced without applying sound energy at the first location 408 and the second location 412.

EXPERIMENTAL EXAMPLE

Two A356 aluminum alloys (Al—Si—Mg), one with 0.09 wt. % Fe and one with 0.91 wt. % Fe, were cast in a graphite mold with the simultaneous application of local ultrasonic intensification to refine the as-cast microstructure. Ultrasonication during casting transformed the morphology of primary Al grains from dendritic (~140-290 microns in size) to globular (~33-36 microns in size). The alloy with high Fe exhibited globular grains at distances up to 45 mm away from the ultrasound probe, while the alloy with lower Fe (0.09 wt. %) exhibited globular grains at distances only up to 6 mm away from the ultrasound probe. Near the location of the ultrasound probe (<2 mm away), a second non-dendritic microstructural morphology was observed with fine aluminum grains (~9-25 microns in size). This unique fine-grained morphology has not been previously reported, contains a greater concentration of Si relative to the globular microstructure, and may be a large, fully eutectic region. Ultrasonication during casting also transformed the morphology of the $\beta$-$Al_5FeSi$ phase particles (which are deleterious to the strength and ductility of the alloy) in the high Fe alloy from needle-like to rectangular, which could enable the greater use of secondary Al alloys. Thermodynamic simulations conducted to calculate the solidification paths of the two alloys studied predict that the $\beta$-$Al_5FeSi$ phase begins to form earlier in the alloy with high Fe. Data suggest that the $\beta$-$Al_5FeSi$ phase (which is more abundant in alloys with high Fe content) may enhance ultrasonically-induced grain refinement.

1. Introduction

Currently, aluminum (Al) castings account for 60 to 70% of the aluminum used in vehicles. As such, Al castings offer cost-effective lightweighting opportunities through part consolidation and integration with other product forms, such as extrusions and sheets. The microstructures of cast aluminum alloys are typically dendritic, inherently less homogeneous, and contain porosity defects. Consequently, they typically have poor mechanical properties, especially compared to wrought materials. Some enhancement in as-cast properties can be achieved by refining the microstructure. One method of refining the microstructure is the use of high thermal conductivity molds (e.g., permanent molds) and/or chills, which increase the local cooling rate during casting. However, chills may not always be practical for certain mold designs and the cooling rate may not necessarily be high enough for refinement further away from the chill. Another method is the addition of grain refiners, which enhance the nucleation rate in the melt. However, grain refiners are limited in their ability to efficiently produce grain sizes smaller than ~100 microns. Additionally, their grain refining effectiveness decreases with repeated recycling because of a combination of loss of the refiners in the dross and agglomeration of particles. The addition of grain refiners to the melt also changes the overall composition of the alloy, making it more difficult to recycle. Another microstructural refinement method is friction stir processing, which is capable of producing grain sizes less than 100 microns in cast aluminum alloys. However, this technology requires additional processing steps following casting, which can increase the total costs.

Ultrasonic melt processing of molten Al alloys is a casting technique used for purposes such as degassing, fine filtration, and the production of non-dendritic, refined microstructures. The proposed mechanisms for how these unique microstructures are formed can be classified into two categories: those that relate to nucleation and those that relate to the fracture of dendrites. The proposed mechanisms that relate to nucleation put forward that ultrasonic cavitation enhances both homogeneous and heterogeneous nucleation, thus increasing the number of primary Al grains in a given volume of material and thereby decreasing average grain size. One hypothesis is that collapsing ultrasonic cavities increase undercooling in the melt, promoting homogeneous nucleation for primary Al grains. Another hypothesis is that ultrasonication increases the wettability of small impurities in the melt, increasing the number of potential heterogeneous nucleation sites. On the other hand, the proposed mechanisms that relate to the fracture of dendrites put forward that a combination of local remelting at the root of dendrite arms along with mechanical deformation leads to the fracture of dendrites, resulting in smaller-sized grain units. It has been hypothesized that this mechanical deformation comes from the implosion of ultrasound cavitation bubbles, the movement of clouds of ultrasound cavitation bubbles, and/or acoustic flow. Recent in-situ radiography experiments have observed the growth, movement, and collapse of ultrasound bubbles in molten Al—Cu alloys and have also observed the fracture of aluminum dendrites in a solidifying Al—Cu alloy. Regardless of the mechanisms that govern its formation, the ultrasonically-refined microstructure has improved strength, ductility, and fatigue life compared to that of the dendritic microstructures.

This study is part of a larger investigation to locally apply ultrasonic intensification in an Al casting to refine the local as-cast microstructure. Rather than applying ultrasound to molten aluminum before/during pouring, in this work ultrasound is applied to the Al as it solidifies in a permanent mold. This approach allows for the active application of the ultrasound field to targeted locations within a larger casting during the casting process itself. This is in comparison to passive chills, bulk grain-refiners, and/or post-casting steps that employ mechanical techniques such as friction processing. In this study, two A356 Al alloys were used, one with low Fe content and another one with added Fe content. The purpose of studying an alloy with added Fe content is to determine if ultrasound can also refine the microstructure of secondary alloys, thus enabling more widespread use of them. Both alloys were cast in a graphite mold. Ultrasound was applied via a probe inserted into the mold through the mold wall. The resultant microstructures were characterized using optical microscopy and electron backscatter diffraction (EBSD). Thermodynamic simulations were conducted to gain insight on the phase types and amounts for the two alloys studied.

2. Methods and Materials

2.1. Materials

This study investigated two Al—Si—Mg alloys provided by Eck Industries, Inc. Table 1 lists the composition of each alloy. The first alloy is an A356 Al alloy with 0.09 wt. % Fe. The second alloy is an A356 Al alloy produced with additional Fe content (A356+Fe). This raised the Fe composition of the alloy to 0.91 wt. %, which mimics the "high" Fe content seen in recycled Al alloys. Prior studies of ultrasonic melt processing of 356 alloys have not investigated an alloy with Fe amounts this high.

TABLE 1

| Composition, in wt. %, of the two alloys studied | | | | | | | | | | | |
|---|---|---|---|---|---|---|---|---|---|---|---|
| Alloy | Si | Mg | Fe | Ti | Cu | Mn | Ni | Sr | Ga | V | Al |
| A356 | 6.72 | 0.42 | 0.09 | 0.11 | 0.00 | 0.00 | 0.01 | 0.00 | 0.01 | 0.02 | Bal. |
| A356 + Fe | 6.78 | 0.35 | 0.91 | 0.11 | 0.01 | 0.01 | 0.00 | 0.01 | 0.00 | 0.02 | Bal. |

2.2. Casting

For casting experiments, approximately 200 g of Al was melted in an alumina crucible inside of a box furnace, heated to approximately 720° C., and cast in a cylindrical graphite mold at room temperature. Graphite was chosen as the mold material because casting Al in a graphite mold at room temperature can simulate the solidification rates of permanent mold casting techniques, which typically use a preheated steel mold. The inner diameter of the mold was 45 mm and the walls were 8 mm thick. A cylindrical Ti-6Al-4V probe, 13 mm in diameter, was inserted into the mold through the mold wall, regardless of whether or not ultrasound was applied. The probe was inserted into the mold prior to pouring the molten Al and was removed once the Al fully solidified and cooled. A type-K thermocouple was placed in the mold in front of the face of the ultrasound probe to measure the temperature of the Al as it cooled. Temperature data were recorded at a rate of 1 Hz. For the experiments where ultrasound was applied, ultrasound was started just before the molten Al alloy was poured into the mold and was stopped once the temperature of the Al cooled below the solidus. The ultrasound probe oscillated longitudinally at a frequency of 20 kHz and power varied up to 750 W to maintain a constant amplitude of 33 μm. After casting, select specimens were heat treated to a T6 condition by solution heat treating at 540° C. for 6 hr., quenching in hot water, then aging at 155° C. for 4 hours.

2.3. Microstructural Characterization

Optical microscopy (OM) and scanning electron microscopy (SEM) were used to characterize the microstructures and measure secondary dendrite arm spacing. Castings were sectioned along the longitudinal axis of the ultrasound probe to produce optical microscopy specimens. These specimens were polished and etched using Keller's reagent to reveal phases for OM and were then repolished for SEM. Primary Al grains were identified and imaged using electron backscatter diffraction (EBSD). Misorientation angles of 15° or more were defined as high-angle grain boundaries separating grains. Only grains with at least 25 pixels were counted and holes of less than 10 pixels were absorbed into the surrounding grain. Iron-rich β-Al5FeSi particles and eutectic silicon particles were identified using energy dispersive X-ray spectroscopy (EDS) and imaged using SEM backscatter diffraction. ImageJ software was used to measure the equivalent grain diameter, sphericity, and aspect ratio of the Al dendrites/grains, Si particles, and β phase particles. Equivalent grain diameter, i.e., the diameter of the dendrite/grain if it were a perfect circle, is defined as $\sqrt{(4A/\pi)}$, where A is the area of the grain. Sphericity, sometimes referred to as roundness, is defined as $4\pi AP^{-2}$, where P is the perimeter of the grain/particle. Sphericity values range from 0 to 1, with values closer to 1 indicating a more circular morphology and values closer to 0 indicating a more needle-like morphology. Aspect ratio is defined as the major axis of the ellipse fit to the grain/particle divided by the minor axis of the ellipse fit to the grain/particle. All measurement uncertainties listed in this study are the sample estimate of standard deviation unless otherwise specified.

3. Results 3.1. Casting

Figure 5:
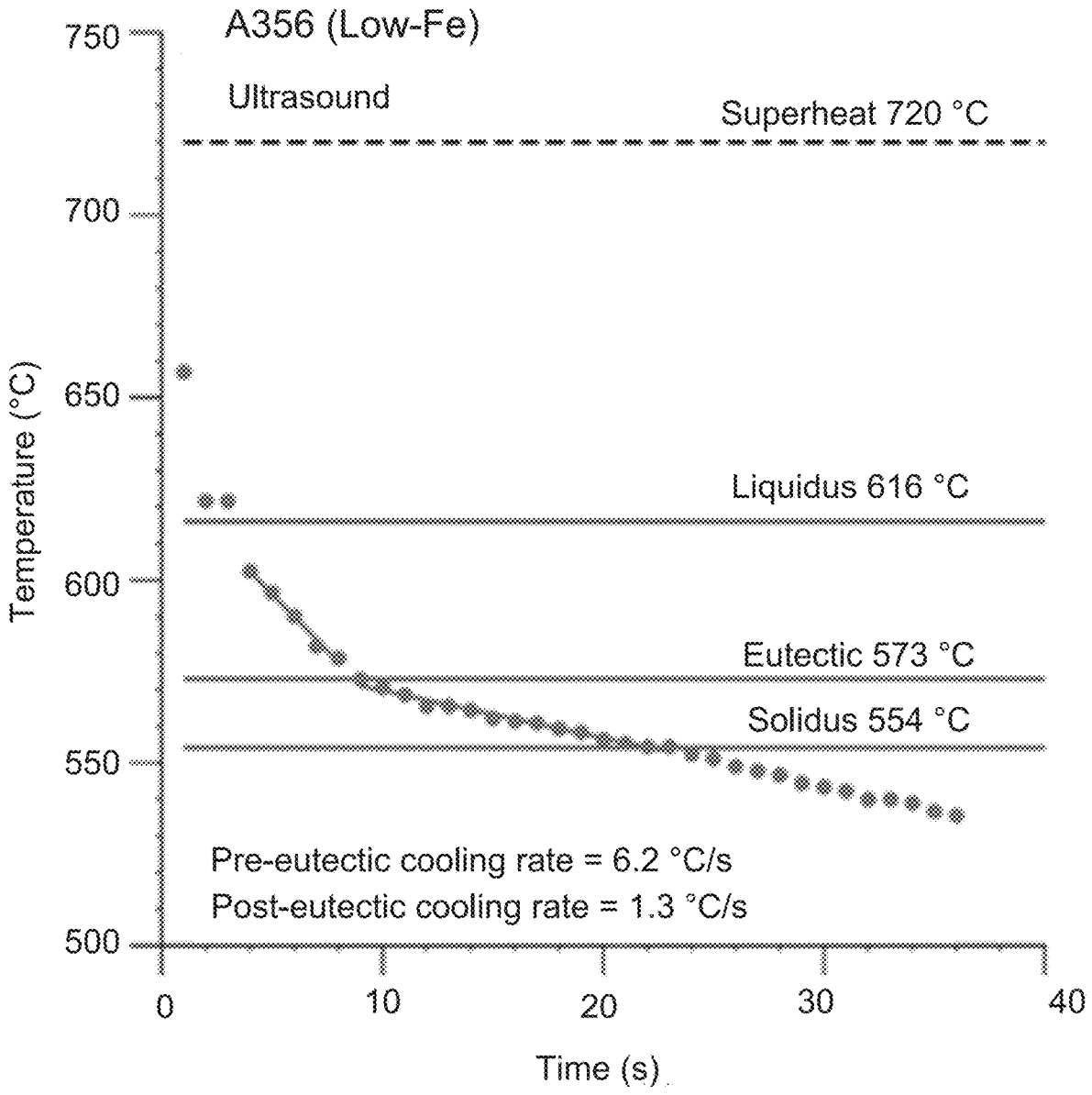
FIG. 5 shows temperature evolution for the A356 alloy cast with local ultrasonic intensification.

FIG. 5 shows an example of thermocouple temperature data acquired during the solidification of the A356 alloy with the application of local ultrasonic intensification. The liquidus, solidus, and eutectic temperatures are indicated in the figure, as well as the superheat temperature of the molten Al. Two average cooling rates are observed, one between the liquidus and the eutectic temperature, and one between the eutectic temperature and the solidus. These average cooling rates are defined as the pre-eutectic cooling rate and the post-eutectic cooling rate, respectively. For the temperature data shown in FIG. 5, the pre-eutectic cooling rate was 6.2° C./s and the post-eutectic cooling rate was 1.3° C./s. Among multiple casting experiments, the average pre-eutectic cooling rate was 5.4±1.0° C./s and the average post-eutectic cooling rate was 1.4±0.5° C./s. Both the pre-eutectic and post-eutectic cooling rates were relatively insensitive to both the presence/absence of local ultrasonic intensification and the Fe content of the alloy. The average cooling rate across casting experiments in this work is similar to the cooling rates typically observed in permanent mold casting processes, which typically range from 0.1 to 1° C./s.

3.2. Microstructural Characterization 3.2.1. Primary Aluminum Dendrites/Grains

Figure 6B:
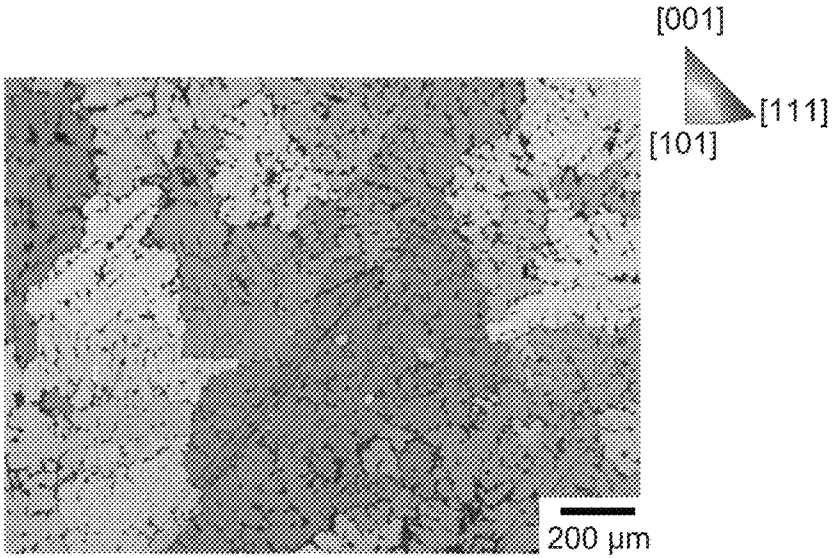
FIG. 6A shows an optical micrograph of typical dendritic microstructure of the A356 alloy cast without ultrasound and FIG. 6B shows an inverse pole figure (IPF-Z) map of typical dendritic microstructure of the A356 alloy cast without ultrasound.
Figure 6A:
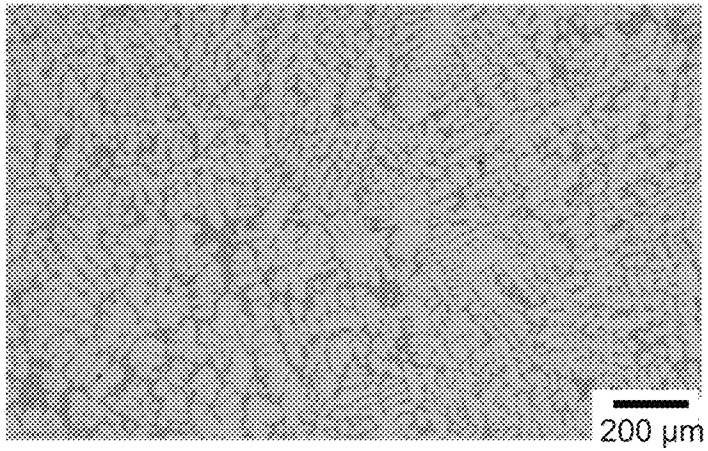

The A356 alloy that was cast without local ultrasonic intensification (i.e., the A356 control casting) exhibited a dendritic microstructure throughout the entire casting, which is shown in FIG. 6. Typical dendritic microstructure of the A356 (low-Fe) alloy cast without ultrasound are depicted in FIG. 6A via an optical micrograph and in FIG. 6B via an inverse pole figure (IPF-Z) map. Only Al grains are indexed in the IPF-Z map. The crystallographic orientation of each Al grain relative to the incident electron beam (z-axis) can be identified using the key. The specimen was etched so that Al appears as one shade and Si appears as another shade in FIG. 6A. Both the optical micrograph and the inverse pole figure (IPF-Z) map were obtained from regions in the same vicinity of one another, approximately 20 mm in front of the ultrasound probe (which did not vibrate during casting). The mean secondary dendrite arm spacing (SDAS) of the primary Al dendrites, measured at multiple locations in the casting, is 24±5 μm and the mean equivalent grain diameter is 290±320 μm.

Figure 7:
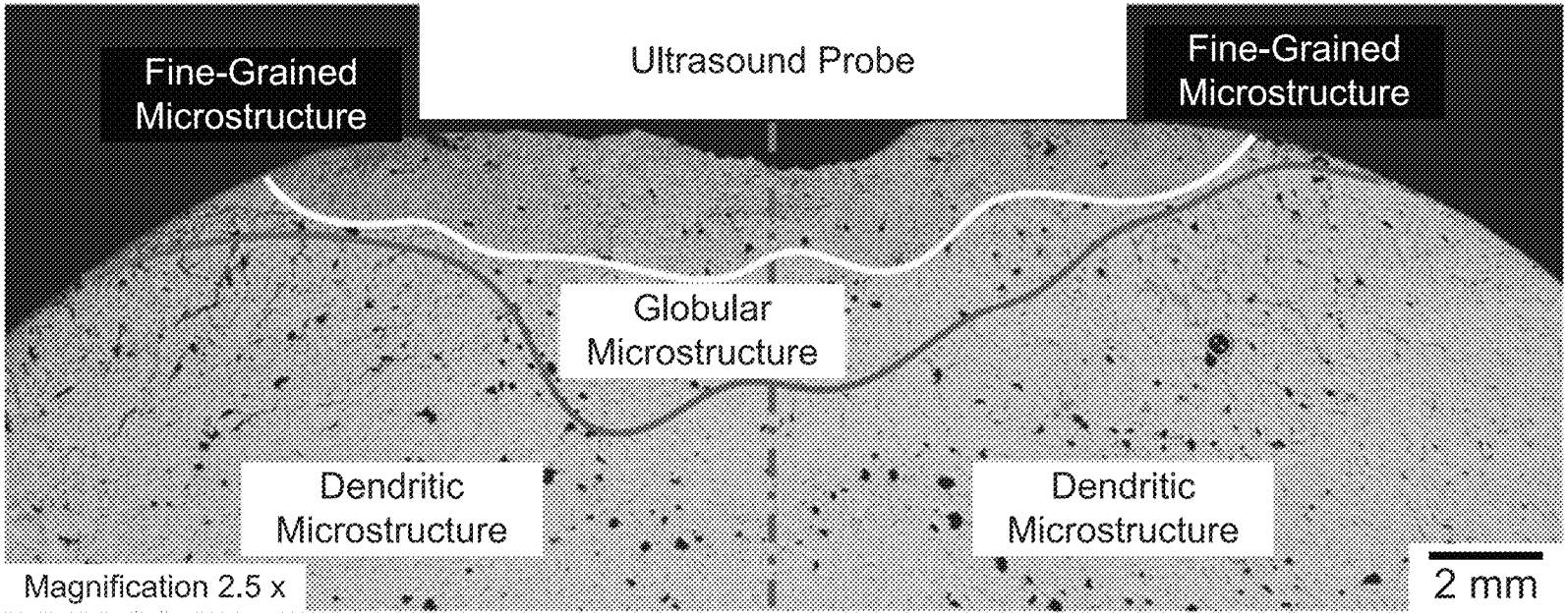
FIG. 7 includes a composite image stitched together from multiple optical micrographs, showing the regions of each microstructural morphology in the A356 ultrasonicated casting relative to the ultrasound probe. The longitudinal axis of the ultrasound probe is identified with a dot-dashed line.

The A356 alloy that was cast with local ultrasonic intensification (i.e., the A356 ultrasonicated casting) exhibited regions with three distinct microstructural morphologies: globular grains, fine grains, and dendritic grains. FIG. 7 shows the regions of the three distinct morphologies relative to the location of the ultrasound probe. The two non-dendritic morphologies were observed only within 6 mm of the ultrasound probe, while the dendritic morphology was observed at greater distances (>6 mm) away from the ultrasound probe. Because both the control casting and the ultrasonicated casting exhibited a similar dendritic morphology, the presence of dendrites in the latter indicates that only a selected region in the ultrasonicated casting was modified while the remainder of the casting retained a dendritic morphology. Therefore, the boundary between the non-dendritic and dendritic morphologies in the A356 ultrasonicated casting indicates the boundary separating the ultrasonically modified and unmodified zones of the casting, respectively. The total area of the ultrasonically modified zone is approximately 60 $mm^2$.

Figure 8B:
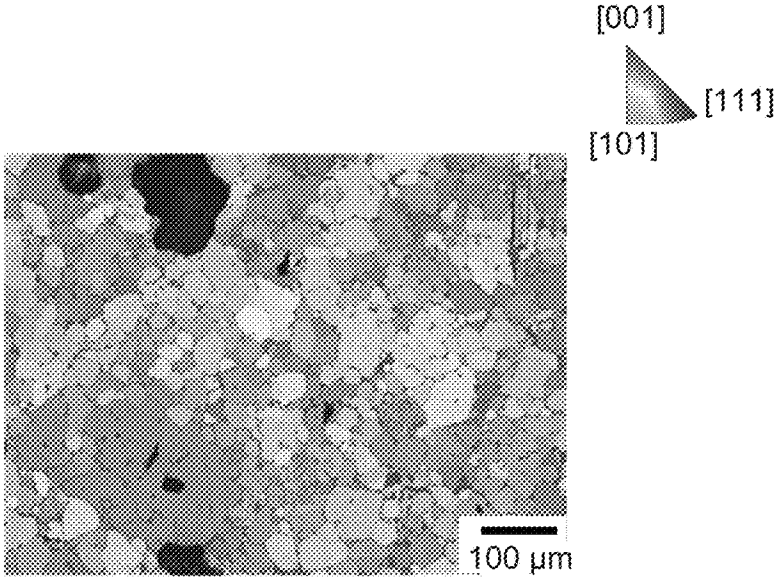
FIG. 8A shows an optical micrograph of the globular microstructure of the A356 alloy cast with ultrasound and FIG. 8B shows an inverse pole figure (IPF-Z) map of the globular microstructure of the A356 alloy cast with ultrasound.
Figure 8A:
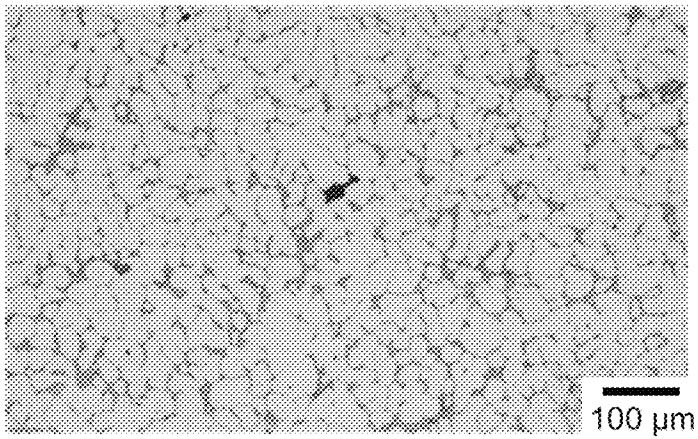

FIG. 8 depicts the globular microstructure of the A356 ultrasonicated casting. The globular microstructure of the A356 (low-Fe) alloy cast with ultrasound is depicted in FIG. 8A via an optical micrograph and in FIG. 8B via an inverse pole figure (IPF-Z) map. Only Al grains are indexed in the IPF-Z map. The crystallographic orientation of each Al grain relative to the incident electron beam (z-axis) can be identified using the key. Both the optical micrograph and the IPF-Z map were captured within the same vicinity of one another, approximately 5 mm in front of the ultrasound probe. The mean equivalent grain diameter of the primary Al grains is 33±20 μm, which is similar to the mean SDAS of the A356 control casting. The globular morphology was only observed at distances of up to 6 mm away from the ultrasound probe. Increasing the vibration amplitude of the ultrasound probe from 33 μm to 78 μm did not increase the size of the ultrasonically-modified zone.

Figure 9B:
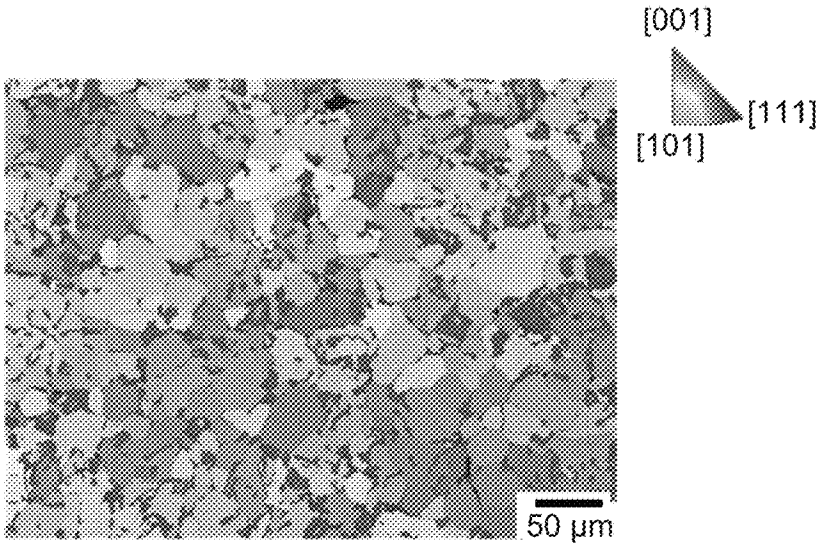
FIG. 9A shows an optical micrograph of the fine grained microstructure of the A356 alloy cast with ultrasound and FIG. 9B shows an inverse pole figure (IPF-Z) map of the fine grained microstructure of the A356 alloy cast with ultrasound.
Figure 9A:
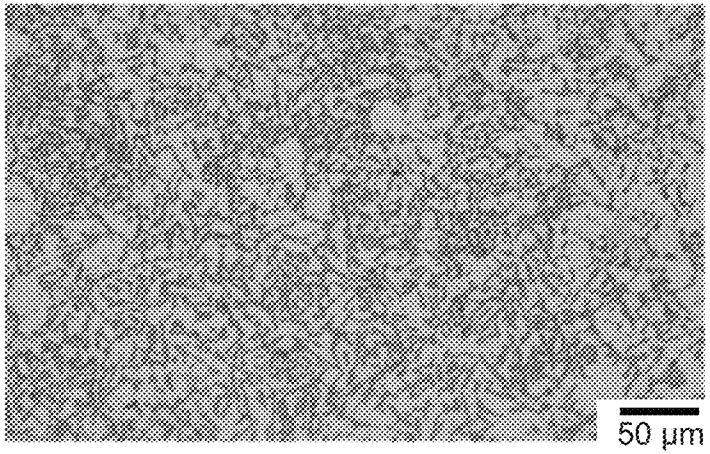

FIG. 9 depicts the fine-grained microstructural morphology of the A356 ultrasonicated casting. The fine grained microstructure of the A356 (low-Fc) alloy cast with ultrasound is depicted in FIG. 9A via an optical micrograph and in FIG. 9B via an inverse pole figure (IPF-Z) map. Only Al grains are indexed in the IPF-Z map. The crystallographic orientation of each Al grain relative to the incident electron beam (z-axis) can be identified using the key. Both the optical micrograph and the IPF-Z map were captured in the same vicinity of one another, approximately 0.5 mm in front of the ultrasound probe. The mean equivalent grain diameter of the Al grains in this ultrasonicated casting is 25±16 μm, which is similar to the mean SDAS of the A356 control casting. While the Al grains in the fine-grained microstructural morphology are only 24% smaller, on average, than those in the globular microstructural morphology, the fine-grained morphology is distinct from the globular microstructure due to the greater area fraction of Si phase particles in the fine-grained morphology, ~15% compared to ~6%.

Figure 10B:
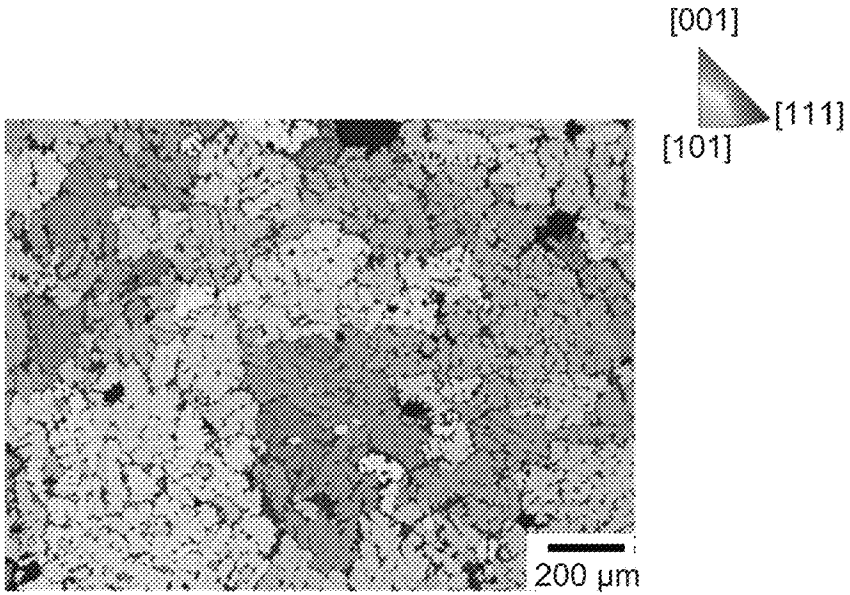
FIG. 10B shows an inverse pole figure (IPF-Z) map of the dendritic microstructure of the A356+Fe (high-Fe) alloy cast without ultrasound.
Figure 10A:
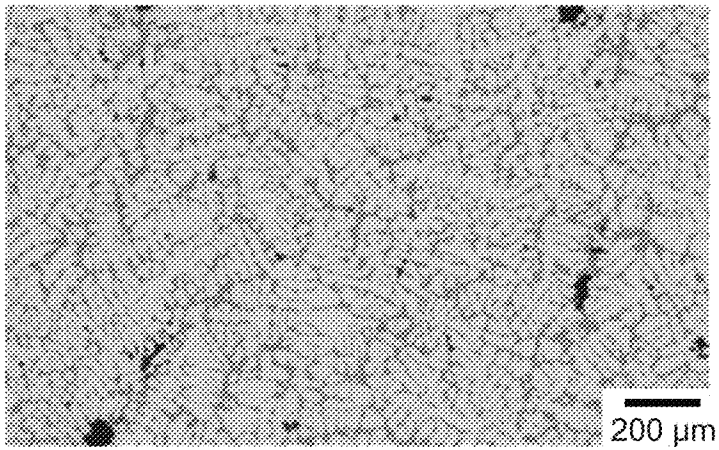
FIG. 10A shows an optical micrograph of the dendritic microstructure of the A356 with intentionally added iron (Fe), indicated here as A356+Fe (high-Fe), that is higher than the standardized composition of A356 alloy, alloy cast without ultrasound

The A356+Fc alloy cast without local ultrasonic intensification (i.e., the A356+Fe control casting) exhibited a dendritic microstructure throughout the entire casting, as shown in FIG. 10. The dendritic microstructure of the A356+Fe (high-Fc) alloy cast without ultrasound is depicted in FIG. 10A via an optical micrograph and in FIG. 10B via an inverse pole figure (IPF-Z) map. Only Al grains are indexed in the IPF-Z map. The crystallographic orientation of each Al grain relative to the incident electron beam (z-axis) can be identified using the key. This dendritic morphology is similar to that of the A356 control casting. Both the optical micrograph and the IPF-Z map were taken within the same vicinity of one another, approximately 15 to 20 mm in front of the ultrasound probe (which did not vibrate during casting). The mean SDAS is 23±5 μm and the mean equivalent grain diameter of the primary aluminum dendrites is 140±210 μm.

Figure 11:
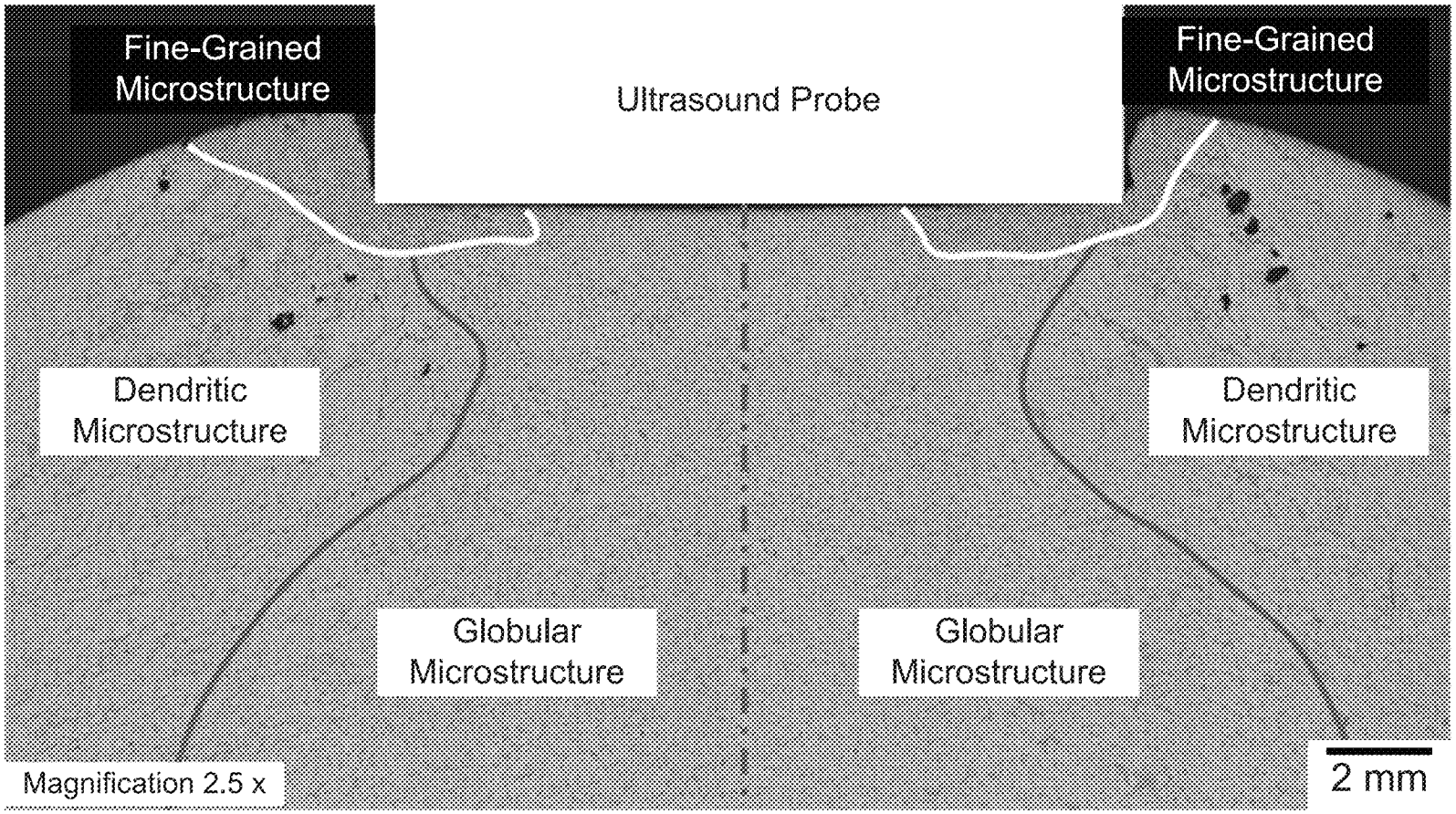
FIG. 11 includes a composite image stitched together from multiple optical micrographs, depicting the regions of each microstructural morphology in the A356+Fe (high Fe) ultrasonicated casting relative to the ultrasound probe. The longitudinal axis of the ultrasound probe is identified with a dot-dashed line.
Figure 12B:
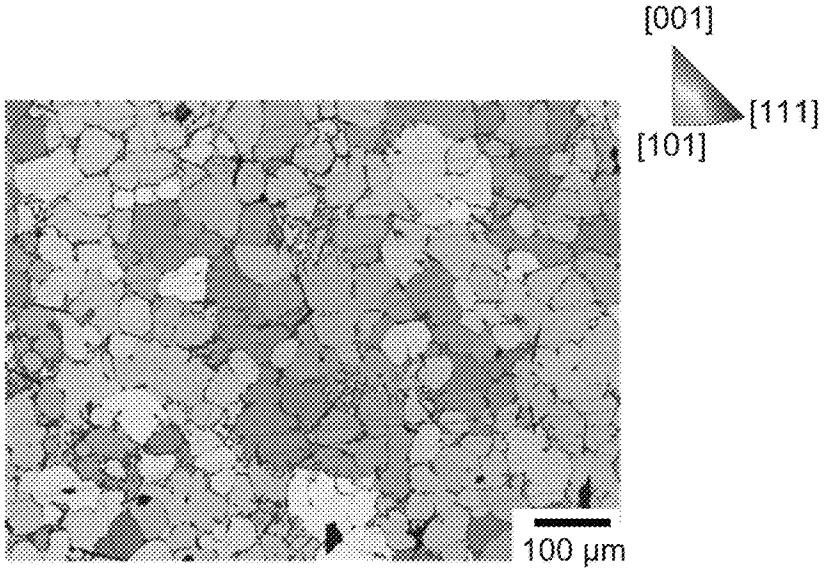
FIG. 12A shows an optical micrograph of the globular microstructure of the A356+Fc (high-Fc) alloy cast with ultrasound and FIG. 12B shows an inverse pole figure (IPF-Z) map of globular microstructure of the A356+Fc (high-Fc) alloy cast with ultrasound.
Figure 12A:
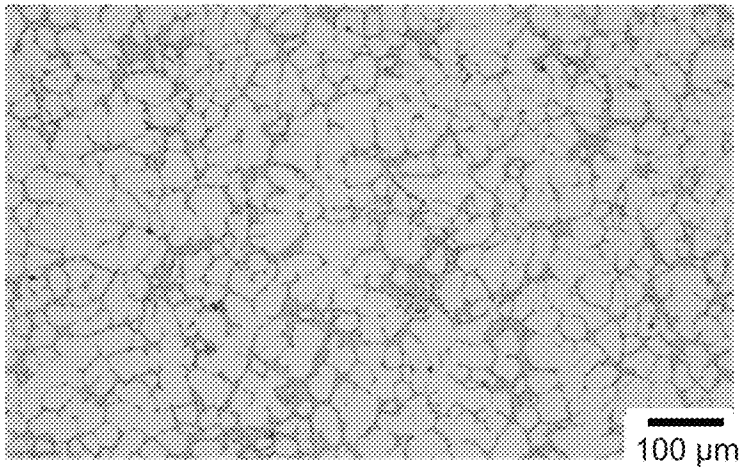

Similar to the A356 ultrasonicated casting, the A356+Fe alloy cast with local ultrasonic intensification (i.e., the A356+Fe ultrasonicated casting) also exhibited regions with three distinct microstructural morphologies: globular grains, fine grains, and dendritic grains. FIG. 11 shows the regions of each morphology with respect to the location of the ultrasound probe. However, the globular grains in the A356+Fe ultrasonicated casting were observed at further distances, up to 45 mm away from the ultrasound probe, as compared to only up to 6 mm in the A356 ultrasonicated casting. The total area of the ultrasonically modified zone is approximately 1230 $mm^2$. FIG. 12 depicts the globular microstructural morphology of the A356+Fe ultrasonicated casting. The globular microstructure of the A356+Fe (high-Fc) alloy cast with ultrasound is depicted in FIG. 12A via an optical micrograph and in FIG. 12B via an inverse pole figure (IPF-Z) map. Only Al grains are indexed in the IPF-Z map. The crystallographic orientation of each Al grain relative to the incident electron beam (z-axis) can be identified using the key. Both the optical micrograph and the IPF-Z map were captured in the same vicinity of one another, approximately 20 mm in front of the ultrasound probe. The mean equivalent grain diameter of the primary Al grains is 36±27 μm, which is of the same order of magnitude as the SDAS of the A356+Fe control casting.

Figure 13B:
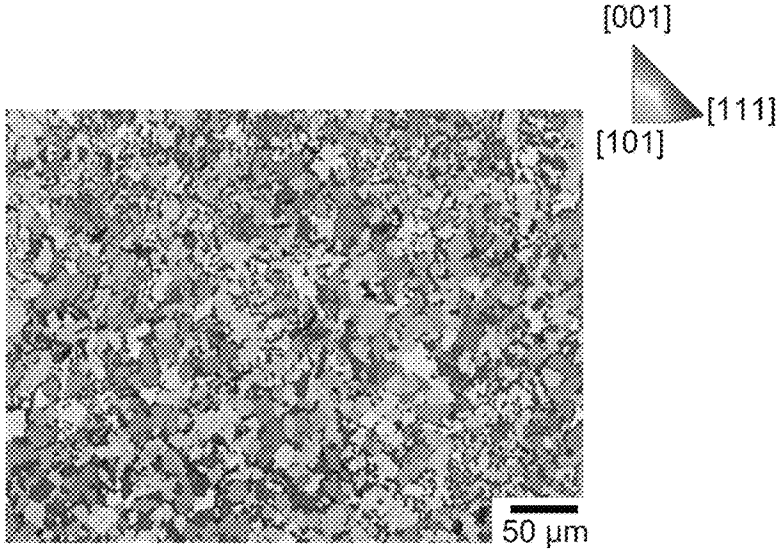
FIG. 13A shows an optical micrograph of the fine grained microstructure of the A356+Fc (high-Fc) alloy cast with ultrasound and FIG. 13B shows an inverse pole figure (IPF-Z) map of the fine grained microstructure of the A356+Fe (high-Fe) alloy cast with ultrasound.
Figure 13A:
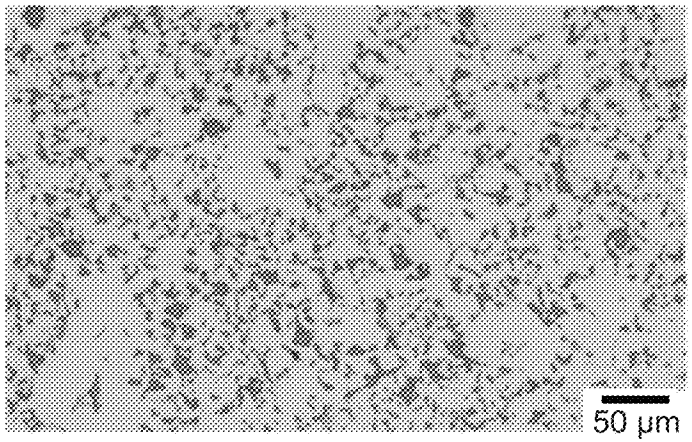

FIG. 13 depicts the fine-grained microstructural morphology of the A356+Fc ultrasonicated casting. The fine grained microstructure of the A356+Fe (high-Fc) alloy cast with ultrasound is depicted in FIG. 13A via an optical micrograph and (b) an inverse pole figure (IPF-Z) map. Only Al grains are indexed in the IPF-Z map. The crystallographic orientation of each Al grain relative to the incident electron beam (z-axis) can be identified using the key. This microstructural morphology was observed at distances up to 2 mm away from the ultrasound probe, and was primarily observed near the edge of the ultrasound probe. The mean equivalent grain diameter of the Al grains is 9.3±5.3 μm, which is 74% finer than the globular grains (36±27 μm) within the same casting. Like the fine-grained microstructural morphology of the A356 ultrasonicated casting, this fine-grained microstructure of the A356+Fe ultrasonicated casting has a greater area fraction of Si phase particles compared to the globular microstructure within the same casting, ~17% compared to ~8%.

Table 2 summarizes the mean equivalent grain diameter, sphericity, and aspect ratio of the primary Al grains in each microstructural morphology region for both of the alloys tested. In the A356 alloy, the application of ultrasound decreased the equivalent grain diameter of the Al grains by 89% and 91% in the globular and fine-grained regions, respectively, compared to the Al dendrites in the control casting (290 μm). In the A356+Fe alloy, the application of ultrasound decreased the equivalent grain diameter of the Al grains by 74% and 93% in the globular and fine-grained microstructural morphologies, respectively, compared to the Al dendrites in the control casting (140 μm). For both the A356 and A356+Fe alloys, the application of local ultrasonic intensification increased sphericity and decreased aspect ratio, suggesting that the primary Al grains of the non-dendritic microstructural morphologies are rounder and more equiaxed than the dendritic grains of the control castings. However, the differences in sphericity and aspect ratio between the different microstructural morphologies are less than the respective measurement uncertainties, and therefore cannot be considered statistically significant.

TABLE 2

Mean equivalent grain diameter, sphericity, and aspect ratio of primary Al grains by alloy and microstructure regions.

| Alloy | Microstructure | Eq. Grain Dia. (μm) | Sphericity | Aspect Ratio |
|---|---|---|---|---|
| A356 | Dendritic (control casting) | 290 ± 320 | 0.36 ± 0.25 | 2.1 ± 1.0 |
| | Globular | 33 ± 20. | 0.52 ± 0.15 | 1.5 ± 0.4 |
| | Fine-grained | 25 ± 16 | 0.46 ± 0.18 | 1.7 ± 0.6 |

TABLE 2-continued

Mean equivalent grain diameter, sphericity, and aspect ratio of primary Al grains by alloy and microstructure regions.

| Alloy | Microstructure | Eq. Grain Dia. (μm) | Sphericity | Aspect Ratio |
|---|---|---|---|---|
| A356 + Fe | Dendritic (control casting) | 140 ± 210 | 0.39 ± 0.22 | 1.8 ± 0.2 |
| | Globular | 36 ± 27 | 0.48 ± 0.18 | 1.5 ± 0.4 |
| | Fine-grained | 9.3 ± 5.3 | 0.56 ± 0.17 | 1.8 ± 0.6 |

Figure 14A:
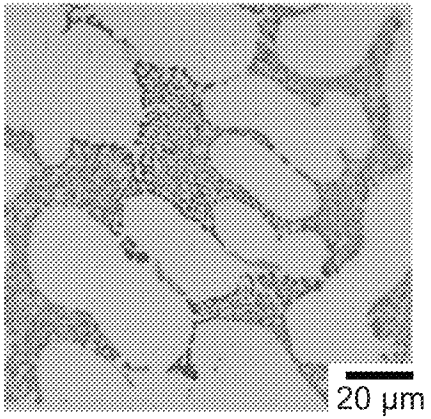
FIG. 14A includes a micrograph depicting the morphology of the Si phase particles in the as-cast conditions of the dendritic microstructural morphology of A356 cast without ultrasound, FIG. 14B includes a micrograph depicting the morphology of the Si phase in the as-cast conditions of the globular microstructural morphology of A356 ultrasonicated casting, and FIG. 14C includes a micrograph depicting the morphology of the Si phase particles in the as-cast conditions of the fine-grained microstructural morphology of A356 ultrasonicated casting.
Figure 14B:
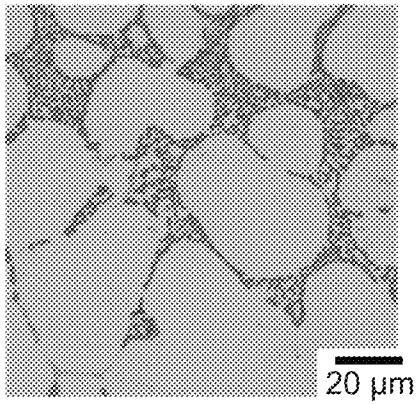
Figure 14C:
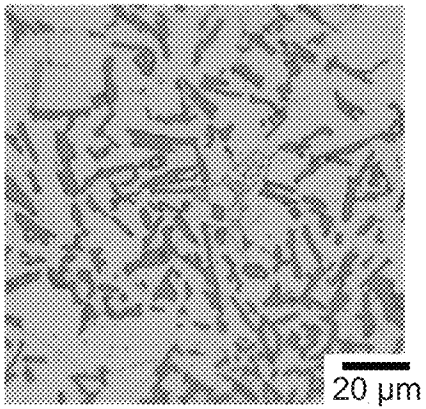

FIG. 14 shows the as-cast microstructures of the A356 control and ultrasonicated castings with particular focus on the Si phase particles. These micrographs depict the morphology of the Si phase particles in the as-cast conditions of the dendritic microstructural morphology of A356 control casting in FIG. 14A, the globular microstructural morphology of A356 ultrasonicated casting in FIG. 14B, and the fine-grained microstructural morphology of A356 ultrasonicated casting in FIG. 14C. The morphology of the Si particles in the dendritic microstructure is fibrous. The Si particles in the globular microstructure have a similar morphology, but are slightly coarser (with 33% larger equivalent grain diameter). The morphology of the Si particles in the fine-grained microstructure is flake-like and highly angular.

Figure 15A:
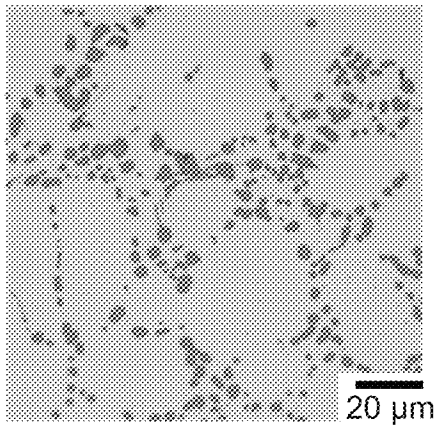
FIG. 15A includes a micrograph depicting the morphology of the Si phase particles in the T6 heat-treated condition for the dendritic microstructural morphology of A356 cast without ultrasound, FIG. 15B includes a micrograph depicting the morphology of the Si phase particles in the T6 condition for the globular microstructural morphology of A356 ultrasonicated casting, and FIG. 15C includes a micrograph depicting the morphology of the Si phase particles in the T6 condition for the fine-grained microstructural morphology of A356 ultrasonicated casting.
Figure 15B:
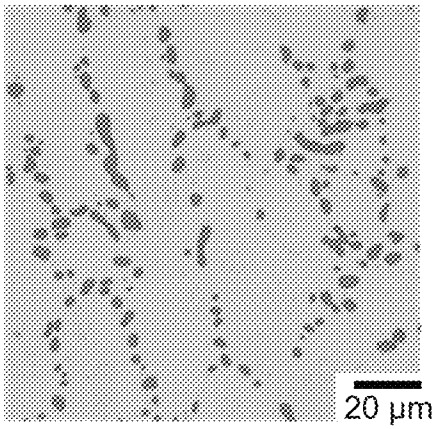
Figure 15C:
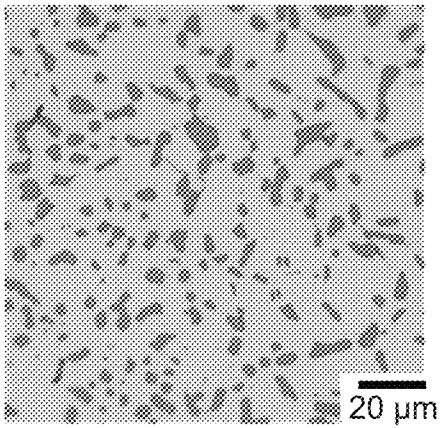

FIG. 15 shows the microstructures of the A356 castings after the T6 heat treatment. These micrographs depict the morphology of the Si phase particles in the T6 condition for: the dendritic microstructural morphology of A356 control casting in FIG. 16A, the globular microstructural morphology of A356 ultrasonicated casting in FIG. 16B, and the fine-grained microstructural morphology of A356 ultrasonicated casting in FIG. 16C. Table 3 lists the area fraction, mean equivalent diameter, and sphericity of the Si particles in the T6 condition. In all three microstructures, the mean equivalent diameter and sphericity of the Si phase particles increased relative to the as-cast condition and the aspect ratio decreased. The increase in sphericity and reduction in aspect ratio both indicate that the T6 heat treatment caused the Si particles to become rounder and more equiaxed. Compared to the Si particles of the dendritic microstructure, the Si particles of the globular microstructure are smaller (with 12% smaller equivalent diameter) and rounder (with 32% greater sphericity), on average, while the Si particles of the fine-grained microstructure are larger (with 31% larger equivalent diameter) but still rounder (with 26% greater sphericity), on average. The smaller and rounder Si particles in the globular microstructure could produce higher strength levels compared to the control casting. The area fraction of Si phase particles in the globular microstructure is similar to that of the dendritic (un-sonicated) microstructure, 6.2% and 6.4%, respectively. The region near the probe with a fine-grained microstructure, however, has a greater area fraction of Si phase particles, 14.9%. This area fraction is quite similar to the volume fraction of Si in the Al—Si eutectic, 14.3%.

TABLE 3

Area fraction, mean equivalent diameter, and sphericity of Si particles in the T6 condition by alloy and microstructure

| Alloy | Microstructure | Area Fraction (%) | Eq. Dia. (μm) | Sphericity |
|---|---|---|---|---|
| A356 | Dendritic (control casting) | 6.4 | 4.45 ± 1.08 | 0.50 ± 0.24 |
| | Globular | 6.2 | 3.90 ± 1.66 | 0.66 ± 0.25 |
| | Fine-grained | 14.9 | 5.84 ± 2.45 | 0.63 ± 0.22 |

TABLE 3-continued

Area fraction, mean equivalent diameter, and sphericity of Si particles in the T6 condition by alloy and microstructure

| Alloy | Microstructure | Area Fraction (%) | Eq. Dia. (μm) | Sphericity |
|---|---|---|---|---|
| A356 + Fe | Dendritic (control casting) | 8.2 | 2.97 ± 1.23 | 0.47 ± 0.24 |
| | Globular | 8.1 | 3.02 ± 1.35 | 0.49 ± 0.21 |
| | Fine-grained | 16.8 | 6.02 ± 3.39 | 0.58 ± 0.22 |

Figure 16A:
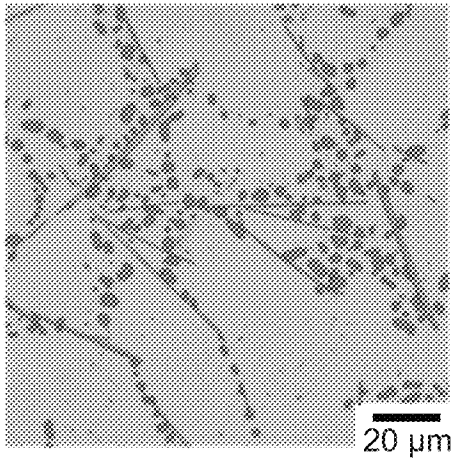
FIG. 16A includes a micrograph depicting the morphology of the Si phase particles in the T6 condition of the dendritic microstructural morphology of the A356+Fe control casting, FIG. 16B includes a micrograph depicting the morphology of the Si phase particles in the T6 condition of the globular microstructural morphology of the A356+Fe ultrasonicated casting, and FIG. 16C includes a micrograph depicting the morphology of the Si phase particles in the T6 condition of the fine-grained microstructural morphology of the A356+Fe ultrasonicated casting.
Figure 16B:
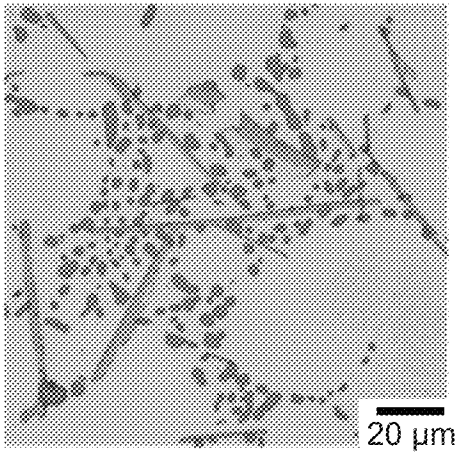
Figure 16C:
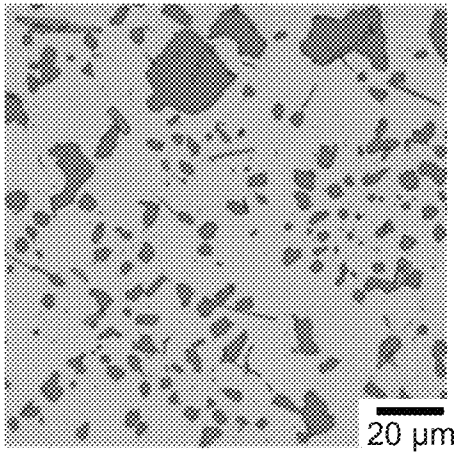

FIG. 16 shows the as-cast microstructures of the A356+Fe control and ultrasonicated castings with particular focus on the Si phase particles. These micrographs depict the morphology of the Si phase particles in the as-cast conditions of the dendritic microstructural morphology of the A356+Fe control casting in FIG. 16A, the globular microstructural morphology of the A356+Fe ultrasonicated casting in FIG. 16B, and the fine-grained microstructural morphology of the A356+Fe ultrasonicated casting in FIG. 16C. The Si particles of the dendritic microstructure in the control casting are fine and fibrous in morphology. The Si particles of the globular microstructure have a similar morphology, but are coarser (with 43% greater equivalent diameter). The Si particles of the fine-grained microstructure are irregular and highly angular in shape, and are significantly coarser than the Si particles of the dendritic microstructure (with 159% greater equivalent diameter).

FIG. 17 depicts the microstructures of the A356+Fe castings after the T6 heat treatment. These micrographs depict the morphology of the Si phase particles in the T6 condition for: the dendritic microstructural morphology of the A356+Fe control casting in FIG. 17A, the globular microstructural morphology of the A356+Fe ultrasonicated casting in FIG. 17B, and the fine-grained microstructural morphology of the A356+Fe ultrasonicated casting in FIG. 17C. Table 3 lists the area fraction, mean equivalent diameter, and sphericity of the Si particles in the T6 condition. As in the A356 castings, the T6 heat treatment increases both the average equivalent diameter and sphericity of the Si phase particles and decreases their average aspect ratio. This increase in sphericity and decrease in aspect ratio indicates that the T6 heat treatment caused the Si phase particles to become rounder and more equiaxed. The Si particles of the dendritic and globular microstructures are similar in area fraction, equivalent diameter, and sphericity. The Si particles in the fine-grained microstructure near the ultrasound probe, however, are approximately twice as large as those of the dendritic and globular microstructures. As in the A356 castings, the area fraction of Si particles in the fine-grained microstructure, 16.8%, is twice that of the dendritic and globular microstructures in the A356 castings.

3.2.3. β-$Al_5FeSi$ Phase Particles

Figure 18:
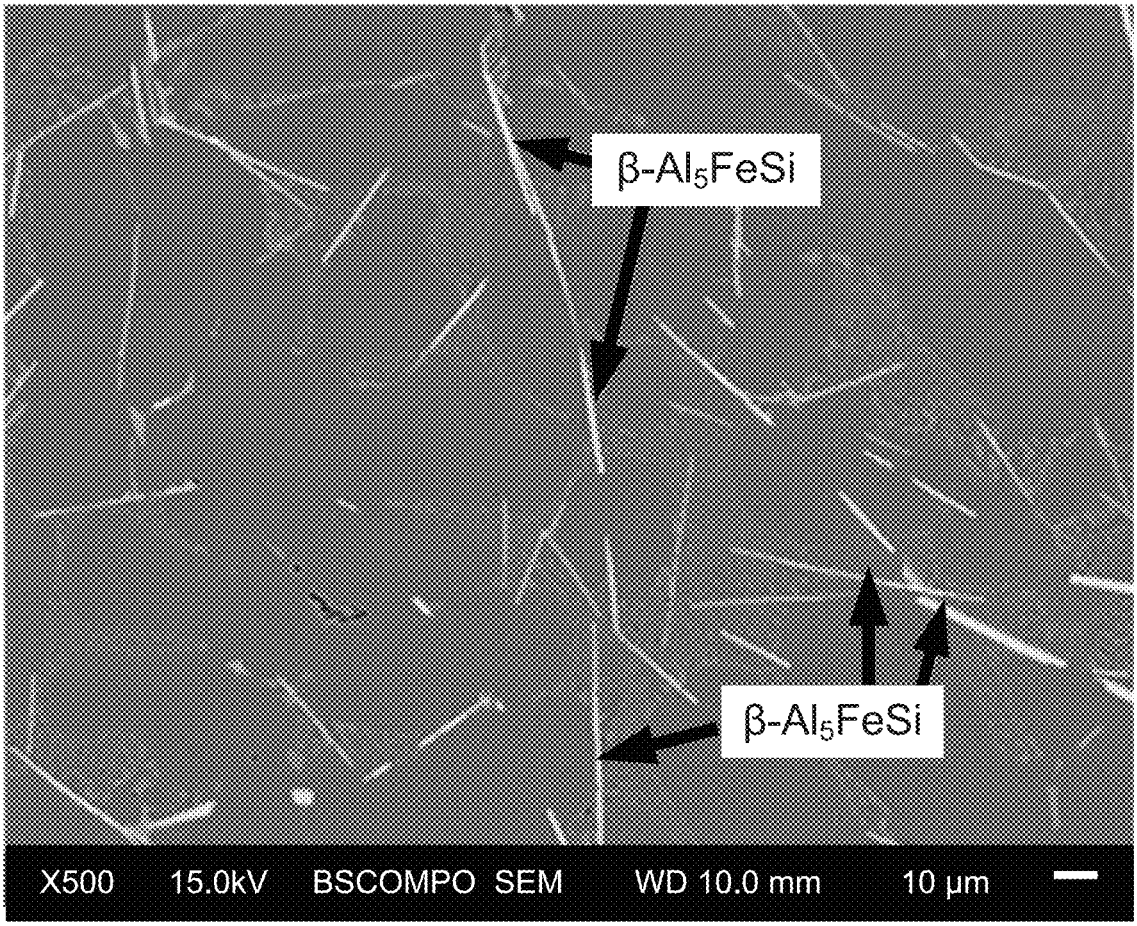
FIG. 18 includes an SEM micrograph, taken in backscatter electron mode that depicts the needle-like β-$Al_5FeSi$ particles, in the dendritic microstructure of the A356+Fe cast without ultrasound, approximately 15 mm in front of the ultrasound probe.
Figure 19B:
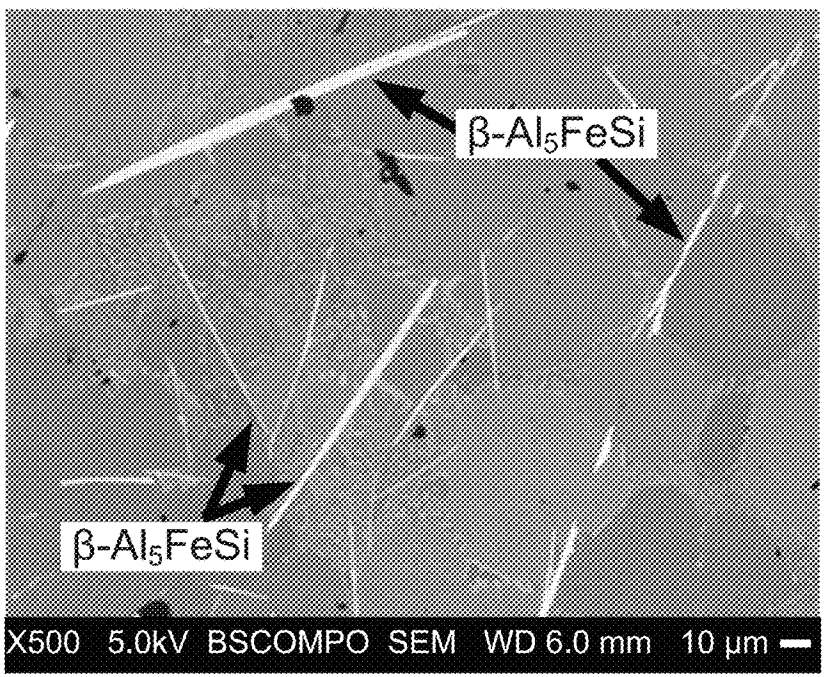
FIG. 19A includes an SEM micrograph, taken in backscatter electron mode that depicts the β-$Al_5FeSi$ particles in the globular microstructures of the A356+Fe ultrasonicated casting 2 mm in front of the ultrasound probe and FIG. 19B includes an SEM micrograph, taken in backscatter electron mode, that depicts the β-$Al_5FeSi$ particles in the globular microstructures of the A356+Fe ultrasonicated casting 15 mm in front of the ultrasound probe.
Figure 19A:
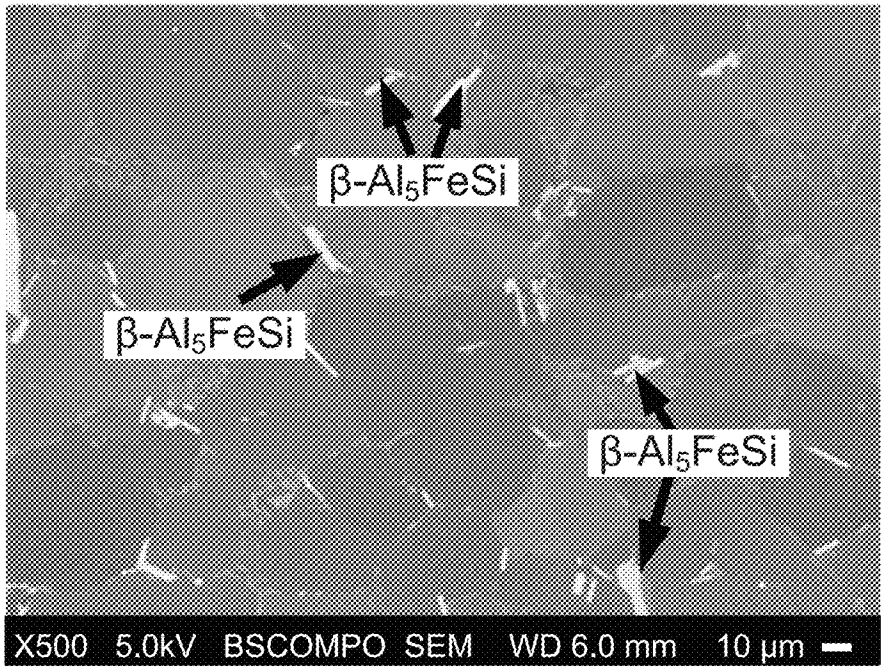
Figure 20:
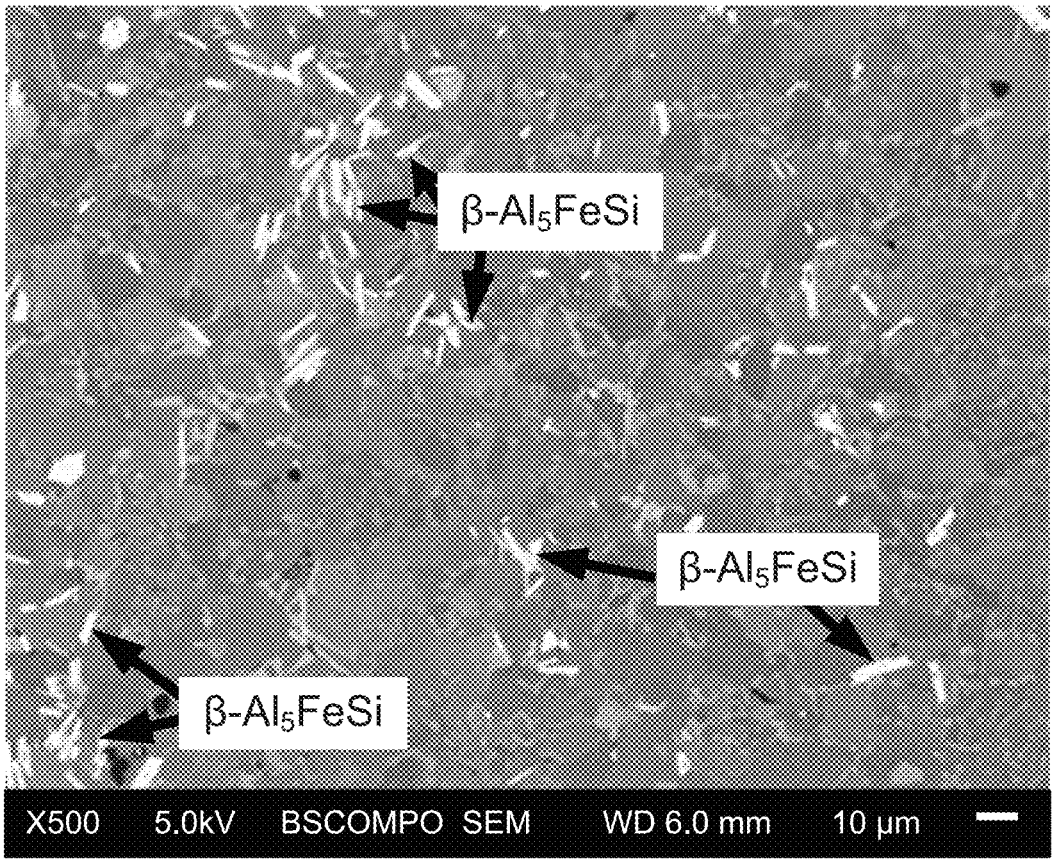
FIG. 20 includes an SEM micrograph, taken in backscatter electron mode that depicts the rectangular morphology of β-$Al_5FeSi$ particles in the fine-grained microstructure of the A356+Fc ultrasonicated casting.

In addition to transforming the primary Al grains from dendritic to globular and fine, equiaxed grains, the application of ultrasound also transformed the morphology of the β-A15FeSi phase particles in the A356+Fe castings. The A356 alloy only contained trace amounts the β-$Al_5FeSi$ phase and therefore was not considered for this analysis. FIG. 18 depicts the needle-like β-$Al_5FeSi$ phase particles of the A356+Fe control casting. FIG. 18 shows an SEM micrograph, taken in backscatter electron mode, depicts the needle-like β-$Al_5FeSi$ particles, in the dendritic microstructure of the A356+Fe control casting approximately 15 mm in front of the ultrasound probe. FIG. 19 shows an SEM micrograph, taken in backscatter electron mode, depicts the β-$Al_5FeSi$ particles in the globular microstructures of the A356+Fe ultrasonicated casting 2 mm in front of the ultrasound probe in FIG. 19A and 15 mm in front of the ultrasound probe in FIG. 19B. The morphology of these β phase particles is rectangular near the ultrasound probe (<5 mm) and needle-like further away from the ultrasound probe (>5 mm). FIGS. 19A and 19B depict the β-$Al_5FeSi$ phase particles of the A356+Fe ultrasonicated casting within the globular microstructural morphology, but at different distances from the ultrasound probe. At distances less than 5 mm, the β-$Al_5FeSi$ phase particles are rectangular in shape (see FIG. 19A). At distances greater 5 mm, however, the β-$Al_5FeSi$ phase particles are needle-like in shape and 10s to 100s of microns in length (see FIG. 19B), similar to their morphology in the A356+Fe control casting. FIG. 20 depicts the β-$Al_5FeSi$ phase particles of the A356+Fe ultrasonicated casting within the fine-grained microstructural morphology, which was observed at distances within 2 mm of the ultrasound probe. FIG. 20 is an SEM micrograph, taken in backscatter electron mode, depicts the rectangular morphology of β-$Al_5FeSi$ particles in the fine-grained microstructure of the A356+Fe ultrasonicated casting. The morphology of these particles is rectangular, the same morphology of the particles in the globular microstructure at distances less than 5 mm from the ultrasound probe. A summary of the mean equivalent diameter, sphericity, and aspect ratio of the β-$Al_5FeSi$ phase particles by microstructural morphology and distance from the ultrasound probe is listed in Table 4.

TABLE 4

Mean equivalent diameter, sphericity, and aspect ratio of β-$Al_5FeSi$ particles in the A356 + Fe castings

| Microstructure | Eq. Dia. (μm) | Sphericity | Aspect Ratio |
|---|---|---|---|
| Dendritic (control casting) | 3.3 ± 1.7 | 0.16 ± 0.11 | 14 ± 11 |
| Globular (<5 mm from ultrasound probe) | 2.5 ± 1.9 | 0.27 ± 0.18 | 5.7 ± 3.2 |
| Globular (>5 mm from ultrasound probe) | 2.7 ± 2.2 | 0.08 ± 0.09 | 27 ± 32 |
| Fine-grained | 2.0 ± 1.6 | 0.34 ± 0.18 | 4.2 ± 3.2 |

4. Discussion

4.1. Comparison to Other Grain Refining Technologies

Local ultrasonic intensification was applied to two Al—Si—Mg alloys, A356 (0.09 wt. % Fe) and A356+Fe (0.91 wt. % Fe), to refine the as-cast microstructure of the alloys as they solidified. Local ultrasonic intensification differs from most other applications of ultrasonic melt processing in that ultrasound is applied to the melt as it solidifies in the mold, rather than applying ultrasound to the melt before it is poured or while it is being poured into a mold. The intent of the present approach was to ensure that the grain-refining effects of the ultrasound can be targeted to a specific local region of the casting. Ultrasonic melt processing has also been historically applied to wrought alloys during ingot casting, resulting in increased plasticity and enabling large-scale ingots to be cast without hot cracking or other casting defects. These ingots would then be forged into the final product form that showed better mechanical properties than if the ingot was not sonicated. Local ultrasonic intensification presented in the current work, however, is expected to be applied to components (e.g., automotive, aerospace, etc. applications) that will be cast in the final part geometry.

The application of local ultrasonic intensification produced two non-dendritic microstructural morphologies: a globular morphology and a fine-grained morphology. The mean equivalent grain diameters of these microstructural morphologies, obtained by molten metal processing, are smaller than the grain sizes produced using conventional casting practices such as chills and grain refiners, and are similar to those of the non-dendritic microstructures produced using solid-state friction stir processing. However, local ultrasonic intensification has the additional benefit of not requiring chemical modifiers (added to molten alloy) or additional post-casting processing steps (applied to the solidified alloy). Thus, local ultrasonic intensification is expected to make components easier to sort and recycle, since the composition is not changed, and also help reduce the costs of implementing the technology, since the microstructure is refined during the casting process itself (i.e., without adding another operation beyond casting).

4.2. Formation of Globular Microstructure

While the globular microstructure, shown in FIGS. 8 and 12, was observed in both the A356 and A356+Fe ultrasonicated castings, the distances at which the globular morphology was observed drastically varied. The globular microstructures in both the A356 and A356+Fc ultrasonicated castings are similar to the microstructures reported in studies investigating ultrasonic melt processing. However, these previous studies investigated alloys with less Fc content (only up to 0.66 wt. % Fc). Some of the primary aluminum grains observed throughout the globular microstructures have a rosette-like appearance, with short and round arms (see FIGS. 8 and 12). This morphology suggests that the application of ultrasound slowed the tip growth velocity of dendrite arms, as observed by Zhang et al. during in-situ tomography experiments with an Al—Cu alloy. For the A356+Fe ultrasonicated casting, the globular microstructure was observed throughout the majority of the specimen and was observed at distances as far as 45 mm away from the location of the ultrasound probe. In the A356 ultrasonicated casting, however, the globular microstructural morphology is only observed at distances much closer to the ultrasound probe (≤6 mm). Repeat casting experiments replicated these same results and increasing the amplitude of the ultrasonic probe vibrations did not increase the distance at which the globular morphology was observed in the A356 alloy.

Additionally, in the A356+Fe ultrasonicated casting, β-$Al_5FeSi$ phase particles within ~5 mm of the ultrasound probe exhibited rectangular morphology, as opposed to the needle-shaped morphology of β-$Al_5FeSi$ phase particles at distances further away from the ultrasound probe and in the A356+Fe control casting. It is interesting to note that the distance at which the β-$Al_5FeSi$ phase particles with a rectangular morphology were observed is similar to the size of the ultrasonically-modified zone of the A356 ultrasonicated casting. This change in morphology suggests that the mechanism by which the β-$Al_5FeSi$ phase grew at distance within ~5 mm of the ultrasound probe in the A356+Fe ultrasonicated casting was different than at distances further away from the ultrasound probe or in the A356 control casting. High Fe content in Al—Si alloys can make the alloy weaker and less ductile, particularly when the brittle and needle-shaped β-$Al_5FeSi$ phase forms. The highly elongated needle-like morphology of the β-$Al_5FeSi$ phase can act as a source of stress concentration within the alloy, which reduces the ductility and ultimate tensile strength of the alloy. A rectangular morphology, which is less elongated, is expected to be a less severe source of stress concentration. Therefore, the application of ultrasound is expected to reduce the deleterious effects of the β-$Al_5FeSi$ phase, thus further enhancing the performance of high Fe alloys. This in turn could enable the greater use of high Fe alloys in applications where strength and ductility are a concern.

4.3. Formation of Fine-Grained Microstructure

The fine-grained microstructures, shown in FIGS. 9 and 13, were only observed within 2 mm of the location of the ultrasound probe in both the A356 and A356+Fe ultrasonicated castings. To our knowledge, these refined microstructures have not been reported in previous studies investigating ultrasonic melt processing. These microstructure have smaller Al grains than the globular morphology and relatively large, blocky Si and β-$Al_5FeSi$ phase particles compared to the respective phases within the globular microstructure region. In the T6 condition, the Si particles in the fine-grained microstructures of the A356 and A356+Fe ultrasonicated castings are 50% larger and 99% larger, respectively, than the Si particles of their respective globular microstructures. Additionally, there is a local enrichment of Si, as the fine-grained microstructures in both ultrasonicated castings have twice the area fraction of Si relative to their respective globular microstructures. In fact, the area fraction of Si (15% and 17% in the A356 and A356+Fe ultrasonicated castings, respectively) is closer to the volume fraction of Si in unmodified Al—Si eutectic than to the overall Si content (6.7%) of the alloy. This suggests that the fine-grained microstructure might be a large region consisting entirely of eutectic Al and Si with no primary Al grains.

The coarse and flakelike morphology of the Si particles in the as-cast A356 fine-grained microstructure (FIG. 9A) resembles the unmodified morphologies of Al—Si castings formed with slow cooling rates. Furthermore, the granular appearance of Si in the as-cast A356+Fe (high-Fc) fine-grained microstructure (FIG. 13A) resembles the morphology of a divorced Al—Si eutectic, which is more commonly observed in hypereutectic Al—Si alloys that form with slow cooling rates. These Si morphologies suggest that fine-grained microstructures in both ultrasonicated castings may have formed in regions where the local cooling rate was slower, which would allow more time for ultrasonic refinement. Since the fine-grained region cools at a slower rate than the rest of the casting, it's solidification would be delayed compared to the rest of the casting. It is possible that as the surrounding regions solidified, the fine-grained region became more saturated with alloying elements (Si) before it cooled enough to begin solidification. Since the A356 alloy is hypoeutectic, as the primary Al grains form during solidification, the surrounding liquid becomes supersaturated with alloying elements (Si). This increased concentration of Si would lower the liquidus in the local region, thus further delaying the onset of solidification and allowing the region to become further saturated, approaching the Al—Si eutectic composition. This sequence of events would then continue until the temperature of the local region reached the eutectic temperature, at which point the region would solidify as a eutectic.

In the A356+Fe ultrasonicated casting, the above described sequence of events appears to have continued until the concentration of Si slightly exceeded the eutectic composition, making the fine-grained region of the A356+Fe ultrasonicated casting hypereutectic and supercooled. As such, the pro-eutectic Si phase would begin to form at a temperature above the eutectic temperature. The abundance of the β-$Al_5FeSi$ phase particles in the A356+Fe casting could serve as nucleation sites for Si particles. Thus, the two proposed requirements for divorced eutectic solidification, an abundance of fine Si particles in the melt before the eutectic reaction and a slow cooling rate across the temperature range of the eutectic reaction, would be fulfilled in the fine-grained region of the A356+Fe ultrasonicated casting.

The slow cooling rate of the fine-grained region compared to the rest of the casting could be the result of dissipation of ultrasonic energy into heat, increased local pressure near the face of the ultrasound probe, or enhanced mixing. Computational fluid dynamics (CFD) simulations of ultrasound applied to molten Al by Riedel et al. measured a higher volume fraction of cavities near the face of a cylindrical ultrasound probe. Additionally, they tracked a high density of collapsed bubbles near the outer edge of the face of the probe, the same region where the fine-grained microstructure was observed in this work (FIGS. 7 and 11). These collapsing bubbles would create a local region of high, oscillating pressure that could potentially fracture solidifying dendrites. These collapsing cavitation bubbles could also create more potential sites for heterogeneous nucleation. Another possible reason for the fine-grained microstructure could be related to the side lobes of the ultrasound probe. These side lobes form as a result of the probe's radial expansion and contraction that occurs simultaneously with the probe's longitudinal oscillations. These side lobes could have been reflected by the curved walls of the mold, producing a region of greater mixing in the immediate vicinity of the face of the probe and the mold wall. Together, these effects could possibly account for the unique fine Al grains that are 24% smaller and 74% smaller, respectively, than the globular fine grains in the corresponding A356 and A356+Fc ultrasonicated castings, which were observed at distances further away from the ultrasound probe.

4.4 Shape of Ultrasonically-Modified Zone

The CFD simulations by Riedel et al. also showed that the shape of the acoustic streaming pattern in molten A356 is tear-drop shaped. However, in a relatively small container, such as the cylindrical mold used in the current work, the acoustic flow is expected to follow the sides of the container until the entire volume of liquid is mixed In the A356+Fe ultrasonicated casting, the shape of the ultrasonically-modified zone (i.e., the regions in the specimen that have a fine-grained or globular microstructural morphology) is tear-drop shaped. This suggests that the energy applied by the ultrasound probe was not sufficient for the acoustic stream to be redirected by the boundaries of the mold.

5. Conclusions

Local ultrasonic intensification was applied to two A356 aluminum alloys, one with 0.09 wt. % Fe (low-Fc) and one with 0.91 wt. % Fe (high-Fe), during solidification in a graphite mold. The resultant microstructures were observed to be significantly refined and were characterized by optical microscopy and SEM. Thermodynamic modeling was conducted to estimate the solidification ranges and phase fractions of each alloy. The following conclusions were obtained:

1. The application of local ultrasonic intensification produced two non-dendritic microstructural morphologies in the ultrasonically modified zone of the castings: (1) a globular microstructure and (2) a fine-grained microstructure (which has not been previously reported). In the A356 (low-Fe) ultrasonicated casting, the primary aluminum grains of the globular and fine-grained microstructures are 89% and 91% smaller than the dendritic grains of the A356 control casting. In the A356+Fe (high-Fe) ultrasonicated casting, the primary aluminum grains of the globular and fine-grained microstructures are 74% and 93% smaller than the dendritic grains of the A356+Fe control casting.

2. After T6 heat treatment, the Si particles in the globular microstructure of the A356 ultrasonicated casting are smaller and rounder (with 12% smaller equivalent diameter and 31% greater sphericity) than those of the A356 control casting. The Si particles in the globular microstructure of the A356+Fe ultrasonicated casting, however, are approximately equivalent in size and roundness (with 2% larger equivalent diameter and 5% greater sphericity) to those of the A356+Fe control casting.
3. While the Al grains in the fine-grained microstructure region of the ultrasonicated castings are refined significantly, the Si particles are coarse relative to the Si particles in their respective control castings, even after a T6 heat treatment. The average equivalent diameter of the Si particles of the fine-grained microstructures of the A356 and A356+Fe ultrasonicated castings are 31% larger and 102% larger, respectively, than their respective control castings. The large size and angular morphology of the Si particles in as-cast condition suggests that the region of the fine-grained microstructure cooled at a slower rate than the rest of the casting.
4. The fine-grained microstructure regions of both castings appear to be large regions of fully Al—Si eutectic. In these regions, there in an enrichment of Si compared to their respective globular microstructures (with 2.3 and 2 times as much Si in the fine-grained regions of the A356 and A356+Fe ultrasonicated castings, respectively, compared to the corresponding globular regions). This increased amount of Si may be a result of delayed solidification in the fine-grained region compared to the globular region, allowing the liquid in the fine-grained region to become more saturated with Si prior to solidification.
5. At distances less than 5 mm away from the ultrasound probe in the A356+Fe ultrasonicated casting, the morphology of the β-Al5FeSi particles in the fine-grained and globular microstructures in changed from needle-like to rectangular (with aspect ratios 70% and 59% less, respectively, than the aspect ratio of the β-Al5FeSi particles in the A356+Fe control casting). This ultrasonically driven change in morphology and reduction in aspect ratio is expected to reduce the deleterious stress-concentration effects of the β-$Al_5FeSi$ phase on the bulk strength of the alloy. Thus, the application of ultrasound is expected to further enhance the performance of high-Fe alloys, specifically near the source of ultrasound.
6. Despite being cast using the same conditions, the size of the ultrasonically modified zone in the A356+Fe (high-Fc) ultrasonicated casting was 20 times larger than that of the A356 (low-Fe) ultrasonicated casting. This suggests that increased Fe content may enhance the ability of ultrasound to refine the microstructure.
7. The larger modified zone in the high-Fe alloy is hypothesized to be due to the β-$Al_5FeSi$ phase serving as additional nucleation sites for the primary Al grains at temperatures just below the liquidus. These β-$Al_5FeSi$ phase particles could also contribute to the fragmentation of dendrites.

What is claimed is:

1. A method comprising:

applying heat to an amount of a metallic material to produce a liquid metallic material;

providing the amount of liquid metallic material to a container, the container having a cavity that is formed into a shape and at least a portion of the cavity is enclosed by a wall having a thickness;

placing a sonication device within an opening in the wall at a location of the container, wherein the opening passes through the wall of the container, the opening is in fluid communication with the cavity of the container, and an end of the sonication device contacts the liquid metallic material while sound energy is being applied to the liquid metallic material;

activating the sonication device to produce the sound energy that is applied to a portion of the amount of the liquid metallic material proximate to the location of the sonication device; and removing, from the container, a formed article comprised of the metallic material and having the shape of the cavity after the amount of the liquid metallic material has solidified.

2. The method of claim 1, wherein:

the formed article includes a bulk region and a modified region;

the modified region is proximate to the location of the sonication device;

grains located in the modified region have first values of one or more characteristics that are different from second values of the one or more characteristics of additional grains located in the bulk region; and the one or more characteristics include at least one of aspect ratio, sphericity, or mean equivalent grain diameter.

3. The method of claim 2, wherein the formed article is comprised of a primary component that comprises at least about 50% by weight of the formed article and first grains of the primary component in the modified region have a mean equivalent grain diameter that is up to about 18 times smaller than the mean equivalent grain diameter of second grains of the primary component included in the bulk region.

4. The method of claim 3, wherein the first grains of the primary component have a sphericity from about 25% to about 60% greater than a sphericity of the second grains of the primary component included in the bulk region.

5. The method of claim 3, wherein the formed article is comprised of a secondary component that comprises no greater than about 30% by weight of the formed article and first additional grains of the secondary component included in the modified region have mean equivalent grain diameters that are from about 20% to about 120% greater than mean equivalent grain diameters of second additional grains of the secondary component in the bulk region.

6. The method of claim 5, wherein the first additional grains of the secondary component included in the modified region have a sphericity that is from about 10% to about 80% greater than a sphericity of the second additional grains of the secondary component included in the bulk region.

7. The method of claim 5, wherein the primary component comprises aluminum and the secondary component comprises silicon.

8. The method of claim 1, comprising:

forming an opening in an exterior portion of the wall of the container having a width that is from about 1.01 times to about 1.10 times a diameter of the sonication device;

wherein the sonication device is placed in the opening before applying sound energy to the liquid metallic material.

9. The method of claim 8, wherein the sonication device is not placed within a cavity of the container while sound energy is being applied to the liquid metallic material.

10. The method of claim 9, wherein the opening partially passes through the wall of the container and at least a portion of an interior portion of the wall remains.

11. The method of claim 1, wherein:

the amount of metallic material is heated to temperatures at least about 50° C. above a melting temperature of the metallic material; and the sonication device is activated until at least a portion of the liquid metallic material cools to a temperature below a liquidus of the metallic material.

12. The method of claim 1, comprising:

removing the sonication device from the wall of the container; and re-using the sonication device to apply sound energy to an additional amount of the metallic material.

13. The method of claim 1, wherein the sound energy produced by the sonication device has a frequency from about 15 kilohertz (kHz) to about 100 kHz and an amplitude from about 20 micrometers to about 210 micrometers.

14. The method of claim 1, wherein a diameter of the sonication device is from about 2 millimeters to about 50 millimeters and the sonication device is comprised of a material having a melting temperature that is greater than an additional melting temperature of the metallic material.

15. A method comprising:

applying heat to an amount of a metallic material to produce a liquid metallic material;

providing the amount of liquid metallic material to a container, the container having a cavity that is formed into a shape and at least a portion of the cavity is enclosed by a wall having a thickness;

applying sound energy to a portion of the amount of the liquid metallic material proximate to a location of an opening in the wall of the container; and removing, from the container, a formed article comprised of the metallic material and having the shape of the cavity after the amount of the liquid metallic material has solidified, wherein:

the formed article includes a bulk region and a modified region with the modified region being proximate to the location of the opening in the wall where the sound energy is applied;

the bulk region is located outside the modified region and comprises a majority of a volume of the formed article;

grains located in the modified region have first values of one or more characteristics that are different from second values of the one or more characteristics of additional grains located in the bulk region; and the one or more characteristics include at least one of aspect ratio, sphericity, or mean equivalent grain diameter.

16. The method of claim 15, wherein the formed article is comprised of a primary component that comprises at least about 50% by weight of the formed article and first grains of the primary component in the modified region have a mean equivalent grain diameter that is up to about 18 times smaller than the mean equivalent grain diameter of second grains of the primary component included in the bulk region.

17. The method of claim 16, wherein the first grains of the primary component included in the modified region have a sphericity from about 25% to about 60% greater than a sphericity of the second grains of the primary component included in the bulk region.

18. The method of claim 15, wherein a sonication device is not placed within a cavity of the container while sound energy is being applied to the liquid metallic material.

* * * * *